US008686102B2

(12) United States Patent
Falk et al.

(10) Patent No.: US 8,686,102 B2
(45) **Date of Patent: *Apr. 1, 2014**

(54) TEXTILES TREATED WITH COPOLYMERS OF EPOXY COMPOUNDS AND AMINO SILANES HAVING ENHANCED WET-STRENGTH

(75) Inventors: Benjamin Falk, Yorktown Heights, NY (US); Smita Brijmohan, Brecksville, OH (US)

(73) Assignee: Momentive Performance Materials Inc., Waterford, NY (US)

( * ) Notice: Subject to any disclaimer, the term of this patent is extended or adjusted under 35 U.S.C. 154(b) by 267 days.

This patent is subject to a terminal disclaimer.

(21) Appl. No.: 12/288,974

(22) Filed: Oct. 24, 2008

(65) Prior Publication Data

US 2009/0117793 A1 May 7, 2009

Related U.S. Application Data

(60) Provisional application No. 60/984,752, filed on Nov. 2, 2007.

(51) Int. Cl.
*C08G 77/18* (2006.01)

(52) U.S. Cl.
USPC ..... 528/34; 525/477

(58) Field of Classification Search
USPC ..... 528/34; 525/477
See application file for complete search history.

(56) References Cited

U.S. PATENT DOCUMENTS 3,980,599 A * 9/1976 Kondo et al. ..... 106/287.11

FOREIGN PATENT DOCUMENTS

| | | |
|---|---|---|
| EP | 1 116 813 | 7/2001 |
| GB | 1 296 136 | 11/1972 |
| GB | 1 491 747 | 11/1977 |
| JP | 50-48293 | 4/1975 |

OTHER PUBLICATIONS

Osterholtz et al. J. Adhesion Sci. Technol. 6(1) (1992) 127-149.*
Mijovic et al., Macromolecules, 27 (1994) 7589-7600.*

* cited by examiner

*Primary Examiner* — Kuo-Liang Peng
(74) *Attorney, Agent, or Firm* — Dominick G. Vicari; Joseph S. Ostroff

(57) ABSTRACT

The present invention provides for textiles treated with a composition comprising the reaction product of e) an oxirane or oxetane compound comprising at least two oxirane or oxetane groups; and f) an amino silane having the formula:

$$N(H)(R^1)R^2Si(OR^3)_{3-a-b-c}(OR^4)_a(R^5Si(OR^6)_d(R^7)_e)_bR^8{}_c$$

with $R^1$ is chosen from the group consisting of H or a monovalent hydrocarbon radical containing one to 20 carbon atoms;

$R^2$ and $R^5$ are independently selected from a group consisting of oxygen or a divalent linear or branched hydrocarbon radical consisting of 1-60 carbons;

$R^4$ is a hydrocarbon radical that contains 3 to 200 carbon atoms;

$R^3$, $R^6$, $R^7$, and $R^8$ and are each independently selected from the group of monovalent linear or branched hydrocarbon radicals having from 1 to 200 carbon atoms;

the subscript b is zero or a positive number and has a value ranging from 0 to 3;

the subscripts a, and c are zero or positive and have a value ranging from 0 to 3 subject to the limitation that $(a+b+c)\leq 3$; and the subscripts d and e are zero or positive and have a value ranging from 0 to 3 subject to the limitation that $(d+e)\leq 3$, wherein the treated textile has enhanced wet strength.

50 Claims, No Drawings

TEXTILES TREATED WITH COPOLYMERS OF EPOXY COMPOUNDS AND AMINO SILANES HAVING ENHANCED WET-STRENGTH

CROSS-REFERENCE TO RELATED APPLICATIONS

This application claims priority to U.S. provisional patent application Ser. No. 60/984,752 filed Nov. 2, 2007.

FIELD OF THE INVENTION

The present invention relates to novel textiles treated with copolymers formed as the reaction product of epoxy compounds and amino silanes providing textiles having enhanced wet-strength.

BACKGROUND OF THE INVENTION

U.S. Pat. No. 4,062,999 A describes a process for treating textile fibers with a mixture of an amino functional silane and an epoxy functional silicone. The unreacted mixture is applied to the fiber then heat-treated in an oven.

U.S. Pat. No. 4,359,545 A describes the process of reacting an amino functional silicone and an epoxy functional silicone onto a textile surface. The blend is applied to a textile then heat-treated in an oven.

U.S. Pat. No. 5,384,340 describes the use of a moisture and or photo curable coatings system. The process involves first reacting an epoxy or methacryl functional silane with an excess of an amino functional silicone. The remaining unreacted amino groups are then reacted with an epoxy or isocyano functional vinyl-containing molecule. The resulting material contains both moisture curable alkoxy silane groups and free radical curable vinyl groups.

EP 1,116,813A1 describes a textile treatment composition containing siloxanes having epoxy- and glycol-functionalities and either an aminosilane or a silicone quaternary ammonium compound. The composition is preferably formulated as an aqueous emulsion. The emulsion is applied to the textile surface followed by heat treatment to cure the mixture.

U.S. Pat. No. 5,102,930 A describes silicone-based fabric finishing agent that is suitable for finishing a fabric material containing keratinous fibers, e.g., wool. The fabric finishing agent is an aqueous emulsion of a hydroxy-containing organopolysiloxane with an admixture of a mixture of colloidal silica and a reaction product of an amino-functional alkoxy silane or a hydrolysis product thereof with an acid anhydride, an epoxy-functional alkoxy silane compound and a curing catalyst.

U.S. Pat. No. 6,475,568 B1 describes the synthesis of non crosslinkable silicone polyether non-(AB)n materials that do not contain silane or reactive groups. Modified silicones can exhibit a variety of physical properties. The polymers can be modified to be hydrophilic, lipophilic and hydrophobic depending on the nature of the organic substituents. Recently, linear alternating copolymers and linear random copolymers have been made using alkyl or polyether, and polydimethylsiloxane units. These materials have shown utility in a variety of applications including personal care (hair conditioners, skin care and color cosmetics), textile treatments, hard surface modifiers, agricultural adjuncts, and the like. Unfortunately these materials are liquids and show limited durability when applied to a surface especially when wet. That is, non-woven textiles treated with the materials described in the art above not only show limited durability but also do not provide good wet strength to the textiles to which it is applied. The subject matter of the present invention overcomes these shortcomings and provides non-woven textiles having enhanced wet-strength and is further described in the sections below.

SUMMARY OF THE INVENTION

The present invention provides for a composition and a textile treated with the composition, the composition comprising the reaction product of a) an oxirane or oxetane compound comprising at least two oxirane or oxetane groups; and b) an amino silane having the formula:

$$N(H)(R^1)R^2Si(OR^3)_{3-a-b-c}(OR^4)_a(R^5Si(OR^6)_d(R^7)_e)_bR^8_c$$

with $R^1$ is chosen from the group consisting of H or a monovalent hydrocarbon radical containing one to 20 carbon atoms;

$R^2$ is selected from a group consisting of a divalent linear or branched hydrocarbon radical consisting of 1-60 carbons;

$R^4$ is a hydrocarbon radical that contains 3 to 200 carbon atoms;

$R^5$ is selected from a group consisting of oxygen or a divalent linear or branched hydrocarbon radical consisting of 1-60 carbons;

$R^3$, $R^6$, $R^7$, and $R^8$ and are each independently selected from the group of monovalent linear or branched hydrocarbon radicals having from 1 to 200 carbon atoms;

the subscript b is zero or a positive number and has a value ranging from 0 to 3;

the subscripts a, and c are zero or positive and have a value ranging from 0 to 3 subject to the limitation that $(a+b+c)\leq 3$; and the subscripts d and e are zero or positive and have a value ranging from 0 to 3 subject to the limitation that $(d+e)\leq 3$ wherein a textile treated with the composition has enhanced wet-strength.

In particular, the present invention is directed to non-woven textiles that are composed of cellulose fibers, such as tissues, that are coated with the compositions described herein. One object of the present invention is to provide treated non-woven textiles that are fairly strong in the dry state, and do not loose their strength as they become soaked with water. That is, the objective is to provide tissues, medical gowns, floor coverings, textiles, diaper liners and other non-woven textiles commonly made from cellulose, polyesters, polypropylene and nylons bound together by thermal, mechanical or chemical means that are coated with at least one of the compositions of the present invention so as to have enhanced wet-strength.

Another objective of the present invention is to provide a simple method to form a durable treatment for non-woven textiles such as tissues, suing the compositions of the present invention.

DETAILED DESCRIPTION OF THE INVENTION

The present invention provides textiles having enhanced wet strength treated with a composition comprising the reaction product of a) an oxirane or oxetane compound comprising at least two oxirane or oxetane groups; and b) an amino silane having the formula:

$$N(H)(R^1)R^2Si(OR^3)_{3-a-b-c}(OR^4)_a(R^5Si(OR^6)_d(R^7)_e)_bR^8_c$$

with $R^1$ is chosen from the group consisting of H or a monovalent hydrocarbon radical containing one to 20 carbon atoms;

$R^2$ is selected from a group consisting of a divalent linear or branched hydrocarbon radical consisting of 1-60 carbons;

$R^4$ is a hydrocarbon radical that contains 3 to 200 carbon atoms;

$R^5$ is selected from a group consisting of oxygen or a divalent linear or branched hydrocarbon radical consisting of 1-60 carbons;

$R^3$, $R^6$, $R^7$, and $R^8$ are each independently selected from the group of monovalent linear or branched hydrocarbon radicals having from 1 to 200 carbon atoms;

the subscript b is zero or a positive number and has a value ranging from 0 to 3;

the subscripts a, and c are zero or positive and have a value ranging from 0 to 3 subject to the limitation that $(a+b+c)\leq 3$; and the subscripts d and e are zero or positive and have a value ranging from 0 to 3 subject to the limitation that $(d+e)\leq 3$, wherein the textile has enhanced wet strength.

The present invention further provides non-woven textiles treated with such reaction product compositions where the oxirane or oxetane compound is selected from the group consisting of siloxanes, hydrocarbons and polyethers particularly where the oxirane or oxetane compound is a siloxane having the formula:

$$M_j M^E_h M^{PE}_i M^H_j D_k D^E_l D^{PE}_m D^H_n T_o T^E_p T^{PE}_q T^H_r Q_s$$

with $$M=R^9R^{10}R^{11}SiO_{1/2};$$

$$M^H=R^{12}R^{13}HSiO_{1/2};$$

$$M^{PE}=R^{12}R^{13}(—CH_2CH(R^{14})(R^{15})_tO(R^{16})_u(C_2H_4O)_v(C_3H_6O)_w(C_4H_8O)_xR^{17})SiO_{1/2};$$

$$M^E=R^{12}R^{13}(R^E)SiO_{1/2}$$

$$D=R^{18}R^{19}SiO_{2/2};\text{ and}$$

$$D^H=R^{20}HSiO_{2/2}$$

$$D^{PE}=R^{20}(—CH_2CH(R^{14})(R^{15})_tO(R^{16})_u(C_2H_4O)_v(C_3H_6O)_w(C_4H_8O)_xR^{17})SiO_{2/2}$$

$$D^E=R^{20}R^ESiO_{2/2}$$

$$T=R^{21}SiO_{3/2};$$

$$T^H=HSiO_{3/2};$$

$$T^{PE}=(—CH_2CH(R^{14})(R^{15})_tO(R^{16})_u(C_2H_4O)_v(C_3H_6O)_w(C_4H_8O)_xR^{17})SiO_{3/2};$$

$$T^E=R^ESiO_{3/2};\text{ and}$$

$$Q=SiO_{4/2};$$

where $R^9$, $R^{10}$, $R^{11}$, $R^{12}$, $R^{13}$, $R^{18}$, $R^{19}$, $R^{20}$, and $R^{21}$ are each independently selected from the group of monovalent hydrocarbon radicals having from 1 to 60 carbon atoms;

$R^{14}$ is H or a 1 to 6 carbon atom alkyl group; $R^{15}$ is a divalent alkyl radical of 1 to 6 carbons; $R^{16}$ is selected from the group of divalent radicals consisting of $—C_2H_4O—$, $—C_3H_6O—$, and $—C_4H_8O—$; $R^{17}$ is H, a monofunctional hydrocarbon radical of 1 to 6 carbons, or acetyl;

$R^E$ is independently a monovalent hydrocarbon radical containing one or more oxirane or oxetane moieties having from one to sixty carbon atoms;

the subscript f may be zero or positive subject to the limitation that when the subscript f is zero, h must be positive;

the subscript h may be zero or positive subject to the limitations that when h is zero, the subscript f must be positive, and that the sum of the subscripts h, l and p is positive;

the subscript k is zero or positive and has a value ranging from about 0 to about 1,000;

the subscript l is zero or positive and has a value ranging from about 0 to about 400 subject to the limitation that the sum of the subscripts h, l and p is positive;

the subscript o is zero or positive and has a value ranging from 0 to about 50;

the subscript p is zero or positive and has a value ranging from 0 to about 30 subject to the limitation that the sum of the subscripts h, l and p is positive;

the subscript s is zero or positive and has a value ranging from 0 to about 20;

the subscript i is zero or positive and has a value ranging from 0 to about 20;

the subscript m is zero or positive and has a value ranging from 0 to about 200;

the subscript q is zero or positive and has a value ranging from 0 to about 30;

the subscript j is zero or positive and has a value ranging from 0 to about 2;

the subscript n is zero or positive and has a value ranging from 0 to about 20;

the subscript r is zero or positive and has a value ranging from 0 to about 30;

the subscript t is zero or one;

the subscript u is zero or one;

the subscript v is zero or positive and has a value ranging from 0 to about 100 subject to the limitation that $(v+w+x)>0$;

the subscript w is zero or positive and has a value ranging from 0 to about 100 subject to the limitation that $(v+w+x)>0$;

the subscript x is zero or positive and has a value ranging from 0 to about 100 subject to the limitation that $(v+w+x)>0$;

or alternatively where the oxirane or oxetane compound is a hydrocarbon having the formula:

$$R^{22}_y(R^{23})_z(R^{24}{}_\alpha)(R^{25})_\beta$$

where $R^{22}$ and $R^{25}$ are independently a monovalent hydrocarbon radical containing one or more oxirane or oxetane moieties having from 3 to 12 carbon atoms;

$R^{23}$ and $R^{24}$ are each selected from the group consisting of H or a linear or branched monovalent hydrocarbon radical of 1 to 200 carbons;

the subscripts y, z, α, β are zero or positive ranging from zero to four subject to the limitation that $(y+\beta)>2$ or alternatively where the oxirane or oxetane compound is a polyether having the formula:

$$R^{26}O(R^{27})_\gamma(C_2H_4O)_\delta(C_3H_6O)_\epsilon(C_4H_8O)_\zeta R^{28}$$

where $R^{26}$ and $R^{28}$ are independently a monovalent hydrocarbon radical containing one or more oxirane or oxetane moieties having from 3 to 12 carbon atoms;

$R^{27}$ is selected from the group of divalent radicals consisting of $—C_2H_4O—$, $—C_3H_6O—$, and $—C_4H_8O—$;

the subscript γ is zero or 1;

the subscript δ is zero or positive and has a value ranging from 0 to about 100 subject to the limitation that $(\delta+\epsilon+\zeta)>0$;

the subscript ϵ is zero or positive and has a value ranging from 0 to about 100 subject to the limitation that $(\delta+\epsilon+\zeta)>0$; and the subscript $\zeta$ is zero or positive and has a value ranging from 0 to about 100 subject to the limitation that $(\delta+\epsilon+\zeta)>0$.

The present invention also provides a textile having enhanced wet strength treated with a reaction product of an epoxy compound and an amino silane further comprising the reaction product of a compound having the formula:

$$R^{29}(R^{30})_{\kappa}Si(OR^{31})_{3-\eta-\theta}(R^{32})_{\eta}(OR^{33})_{\theta}$$

where $R^{29}$ is a monovalent hydrocarbon radical containing one or more oxirane or oxetane moieties having from 3 to 12 carbon atoms;

$R^{30}$ is a divalent hydrocarbon radical consisting of 1-60 carbons and the subscript $\kappa$ has a value of zero or 1; $R^{31}$ and $R^{32}$ are independently selected from the group of monovalent linear or branched hydrocarbon radicals having from 1 to 60 carbon atoms;

the subscript $\eta$ is zero or positive and has a value ranging from 0 to 3;

the subscript $\theta$ is greater than 0 and less than or equal to 3, subject to the limitation that $3-\eta-\theta$ is greater than or equal to zero; and $R^{33}$ is a hydrocarbon radical that contains 3 to 200 carbon atoms.

As used herein the phrase hydrocarbon radical includes hydrocarbon radicals that may be optionally substituted with hetero-atoms particularly nitrogen, oxygen, and sulfur, and may optionally contain ring structures such as oxirane and oxetane groups.

Preferred Embodiments

Preferred embodiments include textiles treated with at least one composition produced by reacting the oxirane or oxetane compounds with amino bearing compounds, the mole ratio of oxirane or epoxy groups to amino groups is preferably about 1 to about 4, more preferably greater than about 1.1 and less than about 3.9, and most preferably greater than about 1.2 and less than about 3.8. $R^1$ is preferably a monovalent hydrocarbon radical of from 1 to about 10 carbon atoms or hydrogen, more preferably from 1 to about 5 carbon atoms or hydrogen, most preferably $R^1$ is H. $R^2$ is preferably a monovalent hydrocarbon radical of from 1 to about 10 carbon atoms more preferably 2 to about 8 carbon atoms, and most preferably 3 to about 5 carbon atoms. $R^4$ is preferably a monovalent hydrocarbon radical of from 3 to about 10 carbon atoms more preferable 3 to about 8 carbon atoms most preferable 3 to about 5 carbon atoms. $R^3$, $R^6$, $R^7$, and $R^8$ are each preferably a monovalent hydrocarbon radical of from 1 to about 20 carbon atoms more preferably 1 to about 15 carbon atoms, most preferably 2 to about 8 carbon atoms. Subscript a is in the range of from 0 to about 3, preferably from about 1 to about 3, more preferably from about 2 to about 3, most preferably from 0 to about 1. Subscript b is in the range of 0 to about 25, more preferably 0 to about 15 and most preferably 3. Subscript c is in the range 0 to about 3, more preferably 0 to about 2, most preferably 0 to about 1. $R^9$, $R^{10}$, $R^{11}$, $R^{12}$, $R^{13}$, $R^{18}$, $R^{19}$, $R^{20}$, and $R^{21}$ are each preferably a monovalent hydrocarbon radical of from 1 to about 4 carbon atoms, more preferably 1 to about 3 carbon atoms, and most preferably 1 carbon atom. The subscripts f, l, m, n, o p, q, r, s are each in the range of 0 to about 200, more preferably 0 to about 100, and most preferably 0 to about 50. The subscript k is in the range of 0 to about 500, more preferably 5 to about 250, and most preferably 5 to about 150. The subscripts v, w, and x are each in the range of 0 to about 50, more preferably 0 to about 35, and most preferably 0 to about 25. $R^{23}$ and $R^{24}$ are each preferably a monovalent hydrocarbon radical of from 5 to about 1000 carbon atoms, more preferably 10 to about 500, and most preferably 10 to about 300. The subscripts $\delta$, $\epsilon$, $\zeta$ are in the range of 0 to about 50 more preferably, 0 to about 30, and most preferably 0 to about 15. $R^{31}$ and $R^{32}$ are each preferably a monovalent hydrocarbon radical of from 1 to about 10 carbon atoms, more preferably 1 to about 8 carbon atoms, and most preferably 1 to about 4 carbon atoms. $R^{33}$ is preferably a monovalent hydrocarbon radical of from 3 to about 100 carbon atoms, more preferably 3 to about 50 carbon atoms, most preferably 3 to about 10 carbon atoms.

Reference is made to substances, components, or ingredients in existence at the time just before first contacted, formed in situ, blended, or mixed with one or more other substances, components, or ingredients in accordance with the present disclosure. A substance, component or ingredient identified as a reaction product, resulting mixture, or the like may gain an identity, property, or character through a chemical reaction or transformation during the course of contacting, in situ formation, blending, or mixing operation if conducted in accordance with this disclosure with the application of common sense and the ordinary skill of one in the relevant art (e.g., chemist). The transformation of chemical reactants or starting materials to chemical products or final materials is a continually evolving process, independent of the speed at which it occurs. Accordingly, as such a transformative process is in progress there may be a mix of starting and final materials, as well as intermediate species that may be, depending on their kinetic lifetime, easy or difficult to detect with current analytical techniques known to those of ordinary skill in the art.

Reactants and components referred to by chemical name or formula in the specification or claims hereof, whether referred to in the singular or plural, may be identified as they exist prior to coming into contact with another substance referred to by chemical name or chemical type (e.g., another reactant or a solvent). Preliminary and/or transitional chemical changes, transformations, or reactions, if any, that take place in the resulting mixture, solution, or reaction medium may be identified as intermediate species, master batches, and the like, and may have utility distinct from the utility of the reaction product or final material. Other subsequent changes, transformations, or reactions may result from bringing the specified reactants and/or components together under the conditions called for pursuant to this disclosure. In these other subsequent changes, transformations, or reactions the reactants, ingredients, or the components to be brought together may identify or indicate the reaction product or final material.

In describing the compositions/emulsions used to coat the non woven textiles of the instant invention as a reaction product of initial materials reference is made to the initial species recited and it is to be noted that additional materials may be added to the initial mixture of synthetic precursors. These additional materials may be reactive or non-reactive. The defining characteristic of the instant invention is that the reaction product is obtained from the reaction of at least the components listed as disclosed. Non-reactive components may be added to the reaction mixture as diluents or to impart additional properties unrelated to the properties of the composition prepared as a reaction product. Thus for example finely divided solids such as pigments may be dispersed into the reaction mixture, before during or after reaction to produce a reaction product composition that additionally comprises the non-reactive component, e.g. a pigment. Additional reactive components may also be added; such components may react with the initial reactants or they may react with the reaction product; the phrase "reaction product" is intended to include those possibilities as well as including the addition of non-reactive components.

Optionally the reaction of component A with component B can be conducted in the presence of a primary or secondary amine that may or may not possess a reactive alkoxy silane moiety. The result will be a reaction product of A, B, and the primary or secondary amine. Examples of these primary amines are; methylamine, ethylamine, propylamine, ethanol amine, isopropylamine, butylamine, isobutylamine, hexylamine, dodecylamine, oleylamine, aniline aminopropyltrimethylsilane, aminopropyltriethylsilane, aminomorpholine, aminopropyldiethylamine benzylamine, napthylamine 3-amino-9-ethylcarbazole, 1-aminoheptaphlorohexane, 2,2,3,3,4,4,5,5,6,6,7,7,8,8,8-pentadecafluoro-1-octanamine and the like. Examples of secondary amines are; methylethylamine, methylhexylamine, methyloctadecylamine, diethanolamine, dibenzylamine, dihexylamine dicyclohexylamine, piperidine, pyrrolidine phthalimide, and the like. Polymeric amines may also be used such.

Applications for Embodiments of the Invention

The product of the reaction of A, an oxirane or oxetane compound possessing two or more oxirane or oxetane groups per molecule and B, an aminosilane, results in a polymer that contains alkoxy silane functional moieties covalently bond to the polymer chain that can be used to treat non-woven textiles in order to enhance desired properties of the textiles such as increased wet strength and softness. These alkoxy silane groups may be activated particularly by hydrolysis and undergo further reactions leading to a cross-linked network. The cross-linking mechanism of silanes is usually a two-step process. The first step usually involves the hydrolysis of an alkoxy silane to form silanols. The second step usually involves the condensation of the silanol groups so produced with themselves or with other reactive organic groups. The reaction between two silanol groups leads to a thermally stable siloxane bond. Silanol groups may also condense reversibly with organic moieties such as alcohols, carboxylic acids, amines, mercaptans, and ketones (other reactive groups). The bonds that are formed are less stable than the siloxane bonds. However when a cross-linked network is formed the rate of the reverse reaction may be severely reduced or even stopped.

The compositions of the present invention may be utilized as pure components, mixtures, or emulsions for the treatment of non-woven textiles such as tissue, paper and the like. As is generally known, emulsions comprise at least two immiscible phases one of which is continuous and the other which is discontinuous. Further emulsions may be liquids or gases with varying viscosities or solids. Additionally the particle size of the emulsions may render them microemulsions and when sufficiently small microemulsions may be transparent. Further it is also possible to prepare emulsions of emulsions and these are generally known as multiple emulsions. These emulsions may be:

1) aqueous emulsions where the discontinuous phase comprises water and the continuous phase comprises the composition of the present invention;
2) aqueous emulsions where the discontinuous phase comprises the composition of the present invention and the continuous phase comprises water;
3) non-aqueous emulsions where the discontinuous phase comprises a non-aqueous hydroxylic solvent and the continuous phase comprises the composition of the present invention; and
4) non-aqueous emulsions where the continuous phase comprises a non-aqueous hydroxylic organic solvent and the discontinuous phase comprises the composition of the present invention.

Depending on the choice of component A and component B it is possible to alter the hydrophilic or lipophilic properties of the resulting reaction product. Accordingly, the textile coated with the above-mentioned components A and B will also have enhanced hydrophilic or lipophilic properties of these components. Thus, depending on the hydrophilic lipophilic balance, the resulting reaction product may be soluble in polar aqueous or hydroxylic solvents or it may be soluble in non-polar solvents such as oils, low molecular weight siloxanes and silicones and the like.

Once these are coated onto the textile, the textile will also experience the same properties. That is, the hydrophilic lipophilic balance of the resulting reaction product will result in imparting different properties to the treated textiles to which they are applied, depending on the hydrophilic lipophilic balance of the reaction product. For example, a more hydrophilic reaction product may impart hydrophilic properties to one or more surfaces of an article of manufacture such as a textile. Conversely, a more hydrophobic reaction product may impart hydrophobic properties of one or more surfaces of an article of manufacture such as a textile. These hydrophilic or hydrophobic properties are readily measured by standardized tests. As used herein, the word textile encompasses both woven textiles and non-woven textiles made from both natural and man-made fibers. Thus treatment of woven and non-woven textiles with the reaction product of the present invention produces an enhanced response to water of the treated textile either increasing the hydrophilicity or hydrophobicity of the textile so treated as measured by standardized tests.

Tests for Hydrophilic Properties:

Upon application and curing a reaction product of the present invention to a nonwoven textile, the reaction product coating the material will not migrate as determined by AATCC Test Method 79-1995 such that an adjacent untreated nonwoven textile exhibits a strike-through time greater than 300 seconds.

Upon application and curing a reaction product of the present invention to a nonwoven textile, the resulting treated non-woven textile will exhibit a water height of less than 0.5 cm, more preferably less than 0.4 cm and most preferably less than 0.1 cm when Inda Standard Test IST 80.4 is performed.

Upon application and curing a reaction product of the present invention to a nonwoven textile, the resulting treated material exhibits a strike through time of less than 100 seconds, more preferably less than 50 seconds, and most preferably less than 10 seconds when Edana Strike Through Time 150.3-96 is performed.

Upon application and curing a reaction product of the present invention to a textile the treated textile exhibits a wet out time of less than 50 sec, more preferably less than 30 sec and most preferably less than 20 sec when AATCC Test Method 79-1992 is performed.

Upon application and curing a reaction product of the present invention to a textile, the treated textile exhibits a wicking value of greater than 10 mm, more preferably greater than 12 mm, and most preferably greater than 15 mm when ASTM D-5237 test protocol is performed.

Tests for Hydrophobic Properties:

Upon application and curing a reaction product of the present invention to a nonwoven textile, the coating will not migrate following as determined by the a greater than 300 second strike-thorough time of an adjacent untreated non-woven textile as described in AATCC Test Method 79-1995.

Upon application and curing a reaction product of the present invention to a nonwoven textile, the non-woven material will exhibit a water height greater than 1.0 cm, more preferably greater than 1.2 cm, and most preferably greater than 1.5 cm when Inda Standard Test IST 80.4 is performed.

Upon application and curing a reaction product of the present invention to a nonwoven textile, the non-woven textile will exhibit a strike through time of greater than 300 seconds, more preferably greater than 350 seconds and most preferably greater than 400 seconds when Edana Strike Through Time 150.3-96 is performed.

Upon application and curing a reaction product of the present invention to a textile, the treated textile exhibits a wet out time of greater than 50 seconds, more preferably greater than 100 seconds and most preferably greater than 200 seconds when AATCC Test Method 79-1992 is performed.

Upon application and curing a reaction product of the present invention to a textile, the treated textile exhibits a wicking value of less than 10 mm, more preferably less than 5 mm, and most preferably less than 2 mm when ASTM D-5237 test protocol is performed.

Upon application and curing a reaction product of the present invention to a textile, the treated textile exhibits a rating value greater than 50 after 5 detergent washes, more preferably a rating value greater than 50 after 10 washes and most preferably a rating value greater than 50 after 20 washes when AATCC test method 22-1989 is performed.

Test for Wet-Strength:

The wet strength of the treated or untreated material can be measured using a Thwing Albert Tissue Burst Tester (EJA Vantage Series). A sample size of at least 4 in.×5 in. is needed for this test. The tissue ply is held at the two short dimension of the tissue by hands and center portion of the tissue can be dipped in to a trough of Deionized water for 5 seconds or until it is entirely soaked whichever is sooner. The tissue is then removed, excess water drained off and placed between the clamps of a Burst tester. The moving crosshead having an adjustable speed can be set at a speed of 60 cm/s. Once activated, the instrument is used to measure the maximum load required to burst the ply of tissue/paper in wet state.

Upon application and curing a reaction product of the present invention to a nonwoven cellulose-based substrate, the treated substrate exhibits an improvement in the wet strength by at least 20%, more preferably greater than 200% and most preferably greater than 1500%, when it is measured by the method described above.

Panel Softness Test:

The Panel Softness Test can be used to measure the softness of a textile such as tissue. Prior to measuring the softness, the tissue samples are stored at normal atmospheric condition for at least 1 week. The temperature during storage is regulated to about 22-25° C. and the relative humidity to about 60-70%. All samples including the control are subjected to identical storage conditions. Treated tissue samples and a control are evaluated by subjective testing of softness. This can be achieved using a panel of softness judges that are presented with the pairs of tissues for evaluation. Each pair properly labeled as $A_x$ and $B_x$ where A and B were randomly selected labels for treated and untreated tissues and x was a unique numerical code for each textile. The judges are recommended to keep their eyes closed at the time of measuring softness with their hands. For each pair, the judges were asked to rate the softness of A versus B. The results can then be gathered and the results tallied to arrive at a softness factor of the textile. An average softness factor can be arrived at using the following equation:

Softness grade=(Total grade of treated tissue−Total grade of untreated tissue)/number of samples.

Upon application and curing a reaction product of the present invention to a nonwoven cellulose-based substrate, the treated substrate exhibits a softness grade of 1-2, more preferably 2-3 and most preferably 3-4 when it is measured by the method described above. 0 is the grade of untreated substrate and higher the grade, higher the softness of the substrate.

Water Absorption:

Water absorption can be measured by measuring the amount of water absorbed by a ply of dry tissue when soaked in a trough containing Deionized water for about 2 seconds to about 30 seconds. The time for soaking is directly proportional to the ease of wetting the textile. After removing the textile from water, the superficial water from the textile is dabbed and the textile is weighed to find wet weight.

Upon application and curing a reaction product of the present invention to a nonwoven cellulose-based substrate, the treated substrate exhibits a water absorption value of at least 2 g/g of substrate, more preferably 3-5 g/g of substrate and most preferably more than 5 g/g of substrate when measured by the method described above.

Water Absorptivity:

The water absorptivity was measured by a standard TAPPI T 432 test method. A 10-μL drop of Deionized water was placed on the textile. The time required for the water drop to be absorbed in the textile can be measured for both treated and no-treated textiles.

For hydrophilicity, upon application and curing a reaction product of the present invention to a nonwoven cellulose-based substrate, the treated substrate exhibits a water absorptivity value of aleast 80 s, more preferably 15-35 s and most preferably less than 15 s when measured by the method described above.

For hydrophobicity, upon application and curing a reaction product of the present invention to a nonwoven cellulose-based substrate, the treated substrate exhibits a water absorptivity value of >100 s, more preferably >200 s and most preferably 500-1000 s when measured by the method described above.

Cosurfactants:

Cosurfactants useful herein include nonionic, cationic, anionic, amphoteric, zwitterionic, polymeric surfactants, or any mixture thereof. Surfactants are typically hydrocarbon based, silicone based or fluorocarbon based.

Moreover, other cosurfactants, that have short chain hydrophobes that do not interfere with superspreading as described in U.S. Pat. No. 5,558,806 herein incorporated by reference are also useful. Additionally, the compositions described above are also useful as the alkyl chloride, alkyl iodide and alkyl bromide analogues, as well as the acid pairs with HCl, acetic acid, propionic acid, glycolic acid, gibberellic acid and the like. One skilled in the art understands the benefits of quaternizernization, which increases solubility and as well as makes possible potential interactions with nonionic and anionic cosurfactants.

Useful surfactants include alkoxylates, especially ethoxylates, containing block copolymers including copolymers of ethylene oxide, propylene oxide, butylene oxide, and mixtures thereof; alkylarylalkoxylates, especially ethoxylates or propoxylates and their derivatives including alkyl phenol ethoxylate; arylarylalkoxylates, especially ethoxylates or propoxylates, and their derivatives; amine alkoxylates, especially amine ethoxylates; fatty acid alkoxylates; fatty alcohol alkoxylates; alkyl sulfonates; alkyl benzene and alkyl naphthalene sulfonates; sulfated fatty alcohols, amines or acid amides; acid esters of sodium isethionate; esters of sodium sulfosuccinate; sulfated or sulfonated fatty acid esters; petroleum sulfonates; N-acyl sarcosinates; alkyl polyglycosides; alkyl ethoxylated amines; and so forth.

Specific examples include alkyl acetylenic diols (SURFONYL—Air Products), pyrrilodone based surfactants (e.g., SURFADONE—LP 100—ISP), 2-ethyl hexyl sulfate, isodecyl alcohol ethoxylates (e.g., RHODASURF DA 530—Rhodia), ethylene diamine alkoxylates (TETRONICS—BASF), ethylene oxide/propylene oxide copolymers (PLURONICS—BASF), Gemini type surfactants (Rhodia) and diphenyl ether Gemini type surfactants (e.g. DOWFAX—Dow Chemical).

Preferred surfactants include ethylene oxide/propylene oxide copolymers (EO/PO); amine ethoxylates; alkyl polyglycosides; oxo-tridecyl alcohol ethoxylates, and so forth.

Coatings:

Typically coatings formulations will require a wetting agent or surfactant for the purpose of emulsification, compatibilization of components, leveling, flow and reduction of surface defects. Additionally, these additives may provide improvements in the cured or dry film, such as improved abrasion resistance, antiblocking, enhanced wetting strength hydrophilic, and hydrophobic properties. Coatings formulations may exists as, Solvent-borne coatings, water-borne coatings and powder coatings.

The coatings components may be employed as: architecture coatings; OEM product coatings such as automotive coatings and coil coatings; Special Purpose coatings such as industrial maintenance coatings and marine coatings.

Typical resin types include: Polyesters, alkyds, acrylics, and epoxies.

As is generally known, emulsions comprise at least two immiscible phases one of which is continuous and the other which is discontinuous. Further emulsions may be liquids with varying viscosities or solids. Additionally the particle size of the emulsions may render them microemulsions and, when sufficiently small, microemulsions may be transparent. Further it is also possible to prepare emulsions of emulsions and these are generally known as multiple emulsions. These emulsions may be:

1) aqueous emulsions where the discontinuous phase comprises water and the continuous phase comprises the epoxy amino silane copolymers of the present invention;
2) aqueous emulsions where the discontinuous phase comprises the epoxy amino silane copolymers of the present invention and the continuous phase comprises water;
3) non-aqueous emulsions where the discontinuous phase comprises a non-aqueous hydroxylic solvent and the continuous phase comprises the epoxy amino silane copolymers of the present invention; and
4) non-aqueous emulsions where the continuous phase comprises a non-aqueous hydroxylic organic solvent and the discontinuous phase comprises the epoxy amino silane copolymers of the present invention.

Non-aqueous emulsions comprising a silicone phase are described in U.S. Pat. No. 6,060,546 and U.S. Pat. No. 6,271,295 the disclosures of which are herewith and hereby specifically incorporated by reference.

As used herein the term "non-aqueous hydroxylic organic compound" means hydroxyl containing organic compounds exemplified by alcohols, glycols, polyhydric alcohols and polymeric glycols and mixtures thereof that are liquid at room temperature, e.g. about 25° C., and about one atmosphere pressure. The non-aqueous organic hydroxylic solvents are selected from the group consisting of hydroxyl containing organic compounds comprising alcohols, glycols, polyhydric alcohols and polymeric glycols and mixtures thereof that are liquid at room temperature, e.g. about 25° C., and about one atmosphere pressure. Preferably the non-aqueous hydroxylic organic solvent is selected from the group consisting of ethylene glycol, ethanol, propyl alcohol, iso-propyl alcohol, propylene glycol, dipropylene glycol, tripropylene glycol, butylene glycol, iso-butylene glycol, methyl propane diol, glycerin, sorbitol, polyethylene glycol, polypropylene glycol mono alkyl ethers, polyoxyalkylene copolymers and mixtures thereof.

Once the desired form is attained whether as a silicone only phase, an anhydrous mixture comprising the silicone phase, a hydrous mixture comprising the silicone phase, a water-in-oil emulsion, an oil-in-water emulsion, or either of the two non-aqueous emulsions or variations thereon. It is capable of being blended into formulations for treatment of non-woven textiles to provide enhanced wet strength as well as other deposition properties and good feel characteristics.

Pulp and Paper

Compositions of the present organomodified silylated surfactant invention are useful in pulp and paper applications, such as paperboard defoamers, and wetting agents for the pulping process. In addition, the organomodified silylated compositions can be used to treat the surface of non-woven textiles so as to increase wet-strength.

Synthetic Examples

Synthesis of Polymer 1

Aminopropyltriisopropoxy silane (12.44 g) and an epoxy encapped polysiloxane with the average structure $CH_2(O)CHCH_2OCH_2CH_2CH_2Si(CH_3)_2O[Si(CH_3)_2O]_9Si(CH_3CH_2CH_2CH_2OCH_2CH(O)CH_2$ (19.8 g) and 2-propanol (10 mL) were combined in a 250-mL flask. The material was refluxed at 85° C. for 8 h. The 2-propanol was removed by stripping under vacuum at 92° C.

Synthesis of Polymer 2

Aminopropyltriisopropoxy silane (5.61 g), an epoxy encapped polysiloxane with the average structure $CH_2(O)CHCH_2OCH_2CH_2CH_2Si(CH_3)_2O[Si(CH_3)_2O]_9Si(CH_3)_2CH_2CH_2CH_2OCH_2CH(O)CH_2$ (20.4 g), an epoxy encapped polyether with the average structure $CH_2(O)CHCH_2O(CH_2CH_2O)_{14}CH_2CH(O)CH_2$ (15.4) and 2-propanol (35 g) were combined in a 250-mL flask. The material was refluxed at 85° C. for 8 h. The 2-propanol was removed by stripping under vacuum at 92° C.

Synthesis of Polymer 3

Aminopropyltriisopropoxy silane (14.97 g) and an epoxy encapped polysiloxane with the average structure $CH_2(O)CHCH_2OCH_2CH_2CH_2Si(CH_3)_2O[Si(CH_3)_2O]_9Si(CH_3)_2CH_2CH_2CH_2OCH_2CH(O)CH_2$ (46.33 g) and 2-propanol (20 g) were combined in a 250-mL flask. The material was refluxed at 85° C. for 12 h. The 2-propanol was removed by stripping under vacuum at 92° C.

Synthesis of Polymer 4

Aminopropyltriisopropoxy silane (22.43 g), an epoxy encapped polysiloxane with the average structure $CH_2(O)CHCH_2OCH_2CH_2CH_2Si(CH_3)_2O[Si(CH_3)_2O]_9Si(CH_3)_2CH_2CH_2CH_2OCH_2CH(O)CH_2$ (38.8 g), an epoxy encapped polyether with the average structure $CH_2(O)CHCH_2O(CH_2CH_2O)_{14}CH_2CH(O)CH_2$ (29.3) and 2-propanol (65 g)

were combined in a 250-mL flask. The material was refluxed at 85° C. for 4 h. The 2-propanol was removed by stripping under vacuum at 92° C.

Synthesis of Polymer 5

Aminopropyltriisopropoxy silane (25.64 g), an epoxy encapped polysiloxane with the average structure $CH_2(O)CHCH_2OCH_2CH_2CH_2Si(CH_3)_2O[Si(CH_3)_2O]_9Si(CH_3)_2CH_2CH_2CH_2OCH_2CH(O)CH_2$ (7.76 g), an epoxy encapped polyether with the average structure $CH_2(O)CHCH_2O(CH_2CH_2O)_{14}CH_2CH(O)CH_2$ (58.61) and 2-propanol (60 g) were combined in a 250-mL flask. The material was refluxed at 81° C. for 6 h. The 2-propanol was removed by stripping under vacuum at 92° C.

Synthesis of Polymer 6

Aminopropyltriisopropoxy silane (9.6 g), an epoxy encapped polysiloxane with the average structure $CH_2(O)CHCH_2OCH_2CH_2CH_2Si(CH_3)_2O[Si(CH_3)_2O]_9Si(CH_3)_2CH_2CH_2CH_2OCH_2CH(O)CH_2$ (29.1 g), an epoxy encapped polyether with the average structure $CH_2(O)CHCH_2O(CH_2CH_2O)_{14}CH_2CH(O)CH_2$ (2.2) and 2-propanol (25 g) were combined in a 250-mL flask. The material was refluxed at 85° C. for 8 h. The 2-propanol was removed by stripping under vacuum at 92° C.

Synthesis of Polymer 7

Aminopropyltriisopropoxy silane (10.7 g), an epoxy encapped polyether with the average structure $CH_2(O)CHCH_2O(CH_2CH_2O)_{14}CH_2CH(O)CH_2$ (14.65 g) and 2-propanol (10 g) were combined in a 250-mL flask. The material was refluxed at 85° C. for 8 h. The 2-propanol was removed by stripping under vacuum at 92° C.

Synthesis of Polymer 8

An epoxy encapped polyether (197.04 g) with the average structure of $CH_2(O)CHCH_2O(CH_2CH_2O)_{14}CH_2CH(O)CH_2$, aminopropyltriisopropoxysilane (87.96 g) and 2-propanol (15 g) were combined in a 500 mL round bottom flask. The solution was heat to reflux and stirred with a magnetic stirrer. The reaction was allowed to remain at reflux until all the epoxy groups were consumed as determined by titration. The resulting material exhibited a dark straw color. The material was transferred to a rotary evaporator and stripped at 70° C. and 4 torr for 2 hrs to remove the 2-propanol.

Synthesis of Polymer 9

Aminopropyltriisopropoxy silane (6.91 g), an epoxy encapped polysiloxane with the average structure $CH_2(O)CHCH_2OCH_2CH_2CH_2Si(CH_3)_2O[Si(CH_3)_2O]_9Si(CH_3)_2CH_2CH_2CH_2OCH_2CH(O)CH_2$ (1.94 g), an epoxy encapped polyether with the average structure $CH_2(O)CHCH_2O(CH_2(CH_3)CH_2O)_{11}CH_2CH(O)CH_2$ (19.72) and 2-propanol (25 g) were combined in a 250-mL flask. The material was refluxed at 85° C. for 8 h. The 2-propanol was removed by stripping under vacuum at 92° C.

Treatment Examples

For silane $[AB]_n$ treatment, various substrates may be used as control materials such as bath tissue, paper towel, cellulose filter paper and recycled paper. For the purpose of demonstrating the effect of silane $[AB]_n$ treatment on the properties of the substrate, it is desirable to use a control nonwoven that does not contain excessive additives. For the most part, pert bath tissue was used as a model substrate unless otherwise specified.

Silane $[AB]_n$ Solution:

A solution of silane $[AB]_n$ was prepared by dissolving 4 g of the polymer in 796 g water. The pH was adjusted to 4 by adding acetic acid and the solution was stirred for 1 day before application. Polymers 2, 4, 5, 7 and 8 were prepared this way.

Polymer 1 Microemulsion:

4 g of polymer 1 was mixed with 2 g of Tergitol TMN 6. Initially, water was added drop-wise and mixed to form the grease-phase. Thereafter it was added gradually with constant stirring until the total weight was 800 g. pH was adjusted to 4 using acetic acid.

Polymer 3 Microemulsion:

4 g of polymer 1 was mixed with 2 g of Renex 36. Initially, water was added drop-wise and mixed to form the grease-phase. Thereafter it was added gradually with constant stirring until the total weight was 800 g. pH was adjusted to 4 using acetic acid.

Polymer 6 Microemulsion:

4 g of polymer 1 was mixed with 1 g of Lutensol TO 6 and 1 g of Lutensol TO 10. Initially, water was added drop-wise and mixed to form the grease-phase. Thereafter it was added gradually with constant stirring until the total weight was 800 g. pH was adjusted to 4 using acetic acid.

Polymer 9 Microemulsion:

4 g of polymer 1 was mixed with 1.28 g of Renex 36 and 0.32 g of Renex 30. Initially, water was added drop-wise and mixed to form the grease-phase. Thereafter it was added gradually with constant stirring until the total weight was 800 g. pH was adjusted to 4 using acetic acid.

The following are some of the treatment procedures employed in this work:

a) Dip Treatment:

This method can be used for the treatment of bath tissue, facial tissue, paper, and cellulose filter paper. As an example, weighed plies of Pert bath tissue were placed in a perforated stainless steel tray such that there was minimal overlap of the plies. In another stainless steel tray, 800 g of silane $[AB]_n$ solution/microemulsion was placed in which the perforated tray containing the tissue was dipped. The tissue was soaked in the silane $[AB]_n$ solution for 30 min, after which the tray containing the tissue was removed from the solution, excess solution drained off and then the tray was placed in oven at 100° C. for 2 h. After heat curing, the tissue plies were cooled to room temperature and weighed to find the uptake of silane $[AB]_n$.

b) Spray Treatment:

This method can be used for the treatment of bath tissue, facial tissue and paper. 10 mL of polymer solution or microemulsion was filled in a bottle fitted with a spray nozzle (Qosmedix #29717). 6 plies of pert tissue or 4 plies of facial tissue were sprayed with the solution starting at the top left, going down while spraying left to right. The wetting was visually observed and any dry spots of the tissue were sprayed on. The plies were air-dried for 1 h and subsequently dried in an oven at 100° C. for 2 h.

Table 1 shows the treatment loading of Silane $[AB]_n$s on Pert bath tissue by dip method and Table 2 shows the treatment loading on facial tissue and cellulose filter paper:

TABLE 1

| Treatment | Treatment, g/m$^2$ |
|---|---|
| Untreated | 0 |
| Polymer 1 | 0.434 |
| Polymer 2 | 0.434 |
| Polymer 3 | 0.434 |
| Polymer 4 | 0.434 |
| Polymer 5 | 0.434 |
| Polymer 6 | 0.434 |
| Polymer 7 | 0.434 |
| Polymer 8 | 0.600 |
| Polymer 9 | 1.735 |

TABLE 2

| | Treatment | Treatment loading, g/m$^2$ |
|---|---|---|
| Facial Tissue | Untreated | 0 |
| Facial Tissue | Polymer 4 | 1.4 |
| Facial Tissue | Polymer 9 | 1.27 |
| Cellulose Filter paper | Untreated | 0 |
| Cellulose Filter paper | Polymer 5 | 1.72 |

Treatment of Paper

Silane $[AB]_n$ was used in the treatment of paper pulp. Arnold Grummer's papermaking kit was used to make the paper. A sheet of white printer paper of the size 8.5 in.×11 in. and basis weight 75 g/m$^2$ was cut in to 8 pieces and put in a blender with 400 mL of tap water. It was crushed in the blender for 30 s. A hand mould equipped with a fine mesh and having inner dimensions of 5.5 in.×8 in. was placed in water bath containing 2100 mL of aqueous solution of Polymer 5. The final concentration of the polymer was 0.25%. The pulp was poured in to the mould and evenly spread with hand. After about 2-3 min the mould was raised from the water bath, excess water drained and then placed on a dry tray. The mould was removed to leave behind pulp on a fine mesh on the tray. Another mesh was placed on the pulp and excess water removed with a sponge. The meshes were carefully removed and the paper was placed between 2 couch sheets. A press bar was used to press down on the couch sheet. The top couch sheet was removed; the new sheet was slowly peeled off and then ironed with a cloth on top. The thickness of the paper was measured with a caliper.

Water Absorptivity:

Water absorptivity was measured by placing a 10-μL drop of deionized water on the tissue. The time required for the water drop to be absorbed in the tissue was measured. Table 3 shows the water absorptivity in seconds for pert tissue treated with silane $[AB]_n$.

TABLE 3

| Treatment | Water absorptivity, s |
|---|---|
| Pert - untreated | 14.3 |
| Polymer 1 | 235 |
| Polymer 2 | 93 |
| Polymer 3 | 555 |
| Polymer 4 | >1500 |
| Polymer 5 | >900 |
| Polymer 6 | 365 |
| Polymer 7 | 85 |
| Polymer 8 | 30.7 |
| Polymer 9 | 16 |

From Table 3, it is evident that the surface of pert bath tissue can be made hydrophilic or hydrophobic based on the molar ratios of siloxane and ethylene oxide units. Most importantly, this property is durable even after cycles of wetting and drying.

Water Absorption:

Water absorption was measured by measuring the amount of water absorbed by a ply of dry tissue when soaked in a trough containing DI water for 2 s-30 s. Time for soaking was dependent on the ease of wetting the tissue. After removing from water, the superficial water from the tissue was dabbed and the tissue weighed to find wet weight. The water absorption of treated and untreated pert tissues is shown in Table 4.

TABLE 4

| Treatment | Water absorption, g/g of tissue |
|---|---|
| Pert - untreated | 5.8 |
| Polymer 1 | 3.54 |
| Polymer 2 | 4.45 |
| Polymer 3 | 5.25 |
| Polymer 4 | 4.73 |
| Polymer 5 | 4.0 |
| Polymer 6 | 3.4 |
| Polymer 7 | 4.24 |
| Polymer 8 | 4.73 |
| Polymer 9 | 3.2 |

The water absorption of untreated pert tissue is 5.8 g/g of tissue. Due to treatment, the water absorptivity can be decreased by as low as 18.45% and as much as 45%.

The water absorption capacity of treated facial tissue and cellulose filter paper is shown in Table 5.

TABLE 5

| | Treatment | Water absorption, g/g of tissue |
|---|---|---|
| Facial Tissue | Untreated | 5.44 |
| Facial Tissue | Polymer 4 | 4.3 |
| Facial Tissue | Polymer 9 | 3.9 |
| Cellulose Filter paper | Untreated | 2.2 |
| Cellulose Filter paper | Polymer 5 | 1.9 |

As with pert bath tissue, the water absorption of facial tissue decreased due to silane $[AB]_n$ treatment. For cellulose paper treated with polymer 5, the water absorption decreased by only 13.6%.

Wet Tear Strength

The wet strength of the treated or untreated material was measured using a Thwing Albert Tissue Burst Tester (EJA Vantage Series). A sample size of at least 4 in.×5 in. is needed for this test. The tissue ply was held by at the two short dimension of the tissue by hands and center portion of the tissue was dipped in to a trough of D.I. water for 5 sec or until it is entirely soaked whichever is sooner. The tissue was removed, excess water drained off and placed between the clamps of the Burst tester. The moving crosshead was set at a speed of 60 cm/s. The instrument measured the maximum load required to burst the ply of tissue/paper in wet state. Wet strengths of pert tissues are shown in Table 6. The results for other substrates such as facial tissue, filter paper and handmade paper are shown in Tables 7 and 8.

TABLE 6

| Treatment | Wet strength, gf |
|---|---|
| Pert - untreated | 2.73 |
| Polymer 1 | 40.45 |
| Polymer 2 | 8.01 |
| Polymer 3 | 31.43 |

TABLE 6-continued

| Treatment | Wet strength, gf |
|---|---|
| Polymer 4 | 28.7 |
| Polymer 5 | 45.63 |
| Polymer 6 | 28.1 |
| Polymer 7 | 8.95 |
| Polymer 8 | 14.7 |
| Polymer 9 | 15.95 |

As shown in Table 6, the untreated tissue has very low wet strength of 2.73 gf. With silane $[AB]_n$ treatment, the wet strength can be improved by at least 3 times. With polymer 5 we found an increase in wet strength by almost 17 times.

TABLE 7

| | Treatment | Wet strength, gf |
|---|---|---|
| Facial Tissue | Untreated | 3.97 |
| Facial Tissue | Polymer 4 | 18.3 |
| Facial Tissue | Polymer 9 | 14.24 |
| Cellulose Filter paper | Untreated | 147.3 |
| Cellulose Filter paper | Polymer 5 | 267.5 |

The wet burst strength of facial tissue was increased by almost 5 times with polymer 4 treatment. A significant improvement in the wet strength of cellulose filter paper was observed with polymer 5 treatment.

TABLE 8

| | Treatment | Wet strength |
|---|---|---|
| Hand-made paper | Untreated | 127.15 gf/mm |
| Hand-made paper | Polymer 5 | 162.10 gf/mm |
| Printer paper | Untreated | 66.75 gf |
| Printer paper | Polymer 5 | 204.281 gf |

For hand-made paper, the peak burst force was divided by the thickness of the paper to account for differences in the thicknesses. With polymer 5 in the pulp bath, the stronger paper could be made. Commercial white printer paper was also treated with polymer 5 and an improvement in wet strength was obtained with this post-treated paper as well.

Panel Softness Test

Prior to measuring the softness, all the tissue samples were stored at normal atmospheric condition for at least 1 week. The temperature during storage was 22-25° C. and the relative humidity was 60-70%. All the samples including the control were subjected to identical storage conditions. 9 pairs of tissue samples, each containing a silane $[AB]_n$-treated tissue and a control were evaluated by subjective testing of softness. A panel of 8 softness judges was presented with the 8 pairs of tissues for evaluation. Each pair was labeled as $A_x$ and $B_x$ where A and B were randomly selected labels for treated and untreated tissues and x was a unique numerical code selected from 1-8 for each treatment polymer. The judges were recommended to keep their eyes closed at the time of measuring softness with their hands. For each pair, the judges were asked to rate the softness of A versus B. This was done for all the 8 sample pairs, one pair at a time. The tissue samples were graded with the following guidelines:

a. If A is a little softer than B, then +1 point is given to A; if B is a little softer than A, then +1 point is given to B
b. If A is surely softer than B, then +2 points are given to A; if B is surely softer than A, then +2 points are given to B
c. If A is a lot softer than B, then +3 points are given to A; if B is a lot softer than A, then +3 points are given to B
d. If A is a whole lot softer than B, then +4 points are given to A; if B is a whole lot softer than A, then +4 points are given to B
e. If the softness of A and B is same, then 0 point is given to both A and B.

After obtaining grades for all the sample pairs from the judges, the grades for each treated tissue were totaled. The grades for corresponding untreated tissues were totaled and subtracted from the total grade for each treated tissue. The final average grade was obtained from equation 1:

$$\text{Softness grade}=(\text{Total grade of treated tissue}-\text{Total grade of untreated tissue})/8 \quad (1).$$

The average softness grades of tissues treated with different silane $[AB]_n$s are listed in Table 9.

TABLE 9

| Treatment | Softness grade |
|---|---|
| Pert - untreated | 0 |
| Polymer 4 | 2.5 |
| Polymer 1 | 3.5 |
| Polymer 8 | 1 |
| Polymer 3 | 3.5 |
| Polymer 5 | 2 |
| Polymer 2 | 2 |
| Polymer 6 | 2.5 |
| Polymer 7 | 3 |
| Polymer 9 | 3 |

With silane $[AB]_n$ treatment the softness of pert tissue can be significantly improved as shown in Table 9.

Additional examples are as follows:

Example A

An epoxy encapped polyether (148.28 g) with the average structure of $CH_2(O)CHCH_2O(CH_2CH_2O)_{22}CH_2CH(O)CH_2$, aminopropyltriisopropoxysilane (51.72 g) and isopropanol (60.00 g) were combined in a 500 mL round bottom flask. The solution was heat to reflux and stirred with a magnetic stirrer. The reaction was allowed to remain at reflux until all the epoxy groups were consumed as determined by titration. The resulting material exhibited a dark straw color. The material was transferred to a rotary evaporator and stripped at 70° C. and 4 torr for 2 hrs to remove the isopropanol.

Example B

Aminopropyltriisopropoxy silane (51.72 g), an epoxy encapped polyether with the average structure $CH_2(O)CHCH_2(OCH_2CH_2)_{7.3}OCH_2CH(O)CH_2$ (148.28 g) and isopropanol (60.00 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example C

Aminopropyltriisopropoxy silane (40.3 g), an epoxy encapped polysiloxane with the average structure $CH_2(O)$ $CHCH_2OCH_2CH_2CH_2Si(CH_3)_2O[Si(CH_3)_2O]_{50}Si(CH_3)_2CH_2CH_2CH_2OCH_2CH(O)CH_2$ (206.12 g) and an epoxy encapped polyether with the average structure $CH_2(O)CHCH_2O(CH_2(CH_3)CH_2O)_7CH_2CH(O)CH_2$ (18.67 g) and isopropanol (88.48 g) was combined in a 500 mL flask. The material was brought to reflux and stirred with an overhead stirrer. The refluxing continued for 15.5 hr until all epoxy groups were consumed as determined by titration. The material was transferred to a rotary evaporator and stripped at 70° C. and 4 torr for 2 hrs to remove the isopropanol.

Example D

Aminopropyltriisopropoxy silane (54.27 g), an epoxy encapped polysiloxane with the average structure $CH_2(O)CHCH_2OCH_2CH_2CH_2Si(CH_3)_2O[Si(CH_3)_2O]_{50}$—$Si(CH_3)_2CH_2CH_2CH_2OCH_2CH(O)CH_2$ (185.70 g) and an epoxy encapped polyether with the average structure $CH_2(O)CHCH_2O(CH_2CH_2O)_7CH_2CH(O)CH_2$ (49.74 g) and isopropanol (507.39 g) was combined in a 1 L flask. The material was brought to reflux and stirred with an overhead stirrer. The refluxing continued for 16 hr until all epoxy groups were consumed as determined by titration. The material was transferred to a rotary evaporator and stripped at 70° C. and 4 torr for 2 hrs to remove the isopropanol.

Example E

Aminopropyltriisopropoxy silane (53.94 g), Bisphenol A Diglycidyl Ether (46.09 g), and isopropanol (25.01 g) was combined in a 250 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example F

Aminopropyltriisopropoxy silane (59.22 g), 1,7-diepoxy octane (20.40 g), an epoxy encapped polysiloxane with the average structure $CH_2(O)CHCH_2OCH_2CH_2CH_2Si(CH_3)_2O[Si(CH_3)_2O]_{50}$—$Si(CH_3)_2CH_2CH_2CH_2OCH_2CH(O)CH_2$ (20.41 g) and isopropanol (25.01 g) was combined in a 250 mL flask. The material was brought to reflux and stirred with an overhead stirrer. The refluxing continued for 16 hr until all epoxy groups were consumed as determined by titration. The material was transferred to a rotary evaporator and stripped at 70° C. and 4 torr for 2 hrs to remove the isopropanol.

Example G

Aminopropyltriisopropoxy silane (41.48 g), 1,6-hexanediol diglycidyl ether (29.43 g), an epoxy encapped polysiloxane with the average structure $CH_2(O)CHCH_2OCH_2CH_2CH_2Si(CH_3)_2O[Si(CH_3)_2O]_{50}$—$Si(CH_3)_2CH_2CH_2CH_2OCH_2CH(O)CH_2$ (29.26 g) and isopropanol (110.01 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example H

Aminopropyltriisopropoxy silane (34.07 g), hydrogenated bisphenol A diglycidyl ether (32.98 g), an epoxy encapped polysiloxane with the average structure $CH_2(O)CHCH_2OCH_2CH_2CH_2Si(CH_3)_2O[Si(CH_3)_2O]_{50}$—$Si(CH_3)_2CH_2CH_2CH_2OCH_2CH(O)CH_2$ (32.96 g) and isopropanol (110.08 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example I

Aminopropyltriisopropoxy silane (12.94 g), an epoxy encapped polysiloxane with the average structure $CH_2(O)CHCH_2OCH_2CH_2CH_2Si(CH_3)_2O[Si(CH_3)_2O]_{25}$—$Si(CH_3)_2CH_2CH_2CH_2OCH_2CH(O)CH_2$ (87.06 g) and isopropanol (30.0 g) was combined in a 250 mL flask. The material was brought to reflux and stirred with an overhead stirrer. The refluxing continued for 16 hr until all epoxy groups were consumed as determined by titration. The material was transferred to a rotary evaporator and stripped at 70° C. and 4 torr for 2 hrs to remove the isopropanol. The material obtained was a clear straw colored liquid.

Example J

Aminopropyltriisopropoxy silane (27.00 g), an epoxy encapped polysiloxane with the average structure $CH_2(O)CHCH_2OCH_2CH_2CH_2Si(CH_3)_2O[Si(CH_3)_2O]_{50}$—$Si(CH_3)_2CH_2CH_2CH_2OCH_2CH(O)CH_2$ (92.70 g), an epoxy encapped polyether with the average structure $CH_2(O)CHCH_2O(CH_2CH_2O)_7CH_2CH(O)CH_2$ (27.69 g) and isopropanol (253.43 g) was combined in a 500 mL flask. The material was brought to reflux and stirred with an overhead stirrer. The refluxing continued for 16 hr until all epoxy groups were consumed as determined by titration. The material was transferred to a rotary evaporator and stripped at 70° C. and 4 torr for 2 hrs to remove the isopropanol.

Example K

Aminopropyltriisopropoxy silane (11.20 g), polybutadiene diglycidyl ether (Mw 3150 g/mol) and isopropanol (100.0 g) was combined in a 500 mL flask. The material was brought to reflux and stirred with an overhead stirrer. The refluxing continued for 23 hr until all epoxy groups were consumed as determined by titration. The material was transferred to a rotary evaporator and stripped at 70° C. and 4 torr for 2 hrs to remove the isopropanol. The material obtained was a viscous clear straw colored liquid.

Example L

Aminopropyltriisopropoxy silane (75.22 g), an epoxy encapped polyether with the average structure $CH_2(O)CHCH_2(OCH_2CH_2)_{6.9}OCH_2CH(O)CH_2$ (124.81 g) and isopropanol (60.00 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example M

Aminopropyltriisopropoxy silane (71.31 g), an epoxy encapped polyether with the average structure $CH_2(O)$ $CHCH_2(OCH_2CH_2)_{11.7}OCH_2CH(O)CH_2$ (128.69 g) and isopropanol (60.00 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example N

Aminopropyltriisopropoxy silane (40.34 g), an epoxy encapped polysiloxane with the average structure $CH_2(O)CHCH_2OCH_2CH_2CH_2Si(CH_3)_2O[Si(CH_3)_2O]_5$—$Si(CH_3)_2CH_2CH_2CH_2OCH_2CH(O)CH_2$ (9.66 g), an epoxy encapped polyether with the average structure $CH_2(O)CHCH_2O(CH_2CH_2O)_{7.7}CH_2CH(O)CH_2$ (50.00 g) and isopropanol (21.01 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example O

Aminopropyltriisopropoxy silane (42.90 g), an epoxy encapped polysiloxane with the structure $CH_2(O)CHCH_2OCH_2CH_2CH_2Si(CH_3)_2OSi(CH_3)_2CH_2CH_2CH_2OCH_2CH(O)CH_2$ (7.11 g), an epoxy encapped polyether with the average structure $CH_2(O)CHCH_2O(CH_2CH_2O)_{7.7}CH_2CH(O)CH_2$ (50.02 g) and isopropanol (20.01 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example P

Aminopropyltriisopropoxy silane (27.00 g), an epoxy encapped polysiloxane with the structure $CH_2(O)CHCH_2OCH_2CH_2CH_2Si(CH_3)_2O[Si(CH_3)_2O]_{50}$—$Si(CH_3)_2CH_2CH_2CH_2OCH_2CH(O)CH_2$ (52.14 g), an epoxy encapped polyether with the average structure $CH_2(O)CHCH_2O(CH_2CH_2O)_9CH_2CH(O)CH_2$ (48.60 g) and isopropanol (200.00 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example Q

Aminopropyltriisopropoxy silane (27.00 g), an epoxy encapped polysiloxane with the structure $CH_2(O)CHCH_2OCH_2CH_2CH_2Si(CH_3)_2O[Si(CH_3)_2O]_{50}Si(CH_3)_2CH_2CH_2CH_2OCH_2CH(O)CH_2$ (13.90 g), an epoxy encapped polyether with the average structure $CH_2(O)CHCH_2O(CH_2CH_2O)_{7.7}CH_2CH(O)CH_2$ (53.69 g) and isopropanol (20.01 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example R

Aminopropyltriisopropoxy silane (71.31 g), an epoxy encapped polyether with the average structure $CH_2(O)CHCH_2(OCH_2CH_2)_{11.7}OCH_2CH(O)CH_2$ (128.69 g) and isopropanol (60.00 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example S

Aminopropyltriisopropoxy silane (15.02 g), an epoxy encapped polysiloxane with the structure $CH_2(O)CHCH_2OCH_2CH_2CH_2Si(CH_3)_2O[Si(CH_3)_2O]_{100}Si(CH_3)_2CH_2CH_2CH_2OCH_2CH(O)CH_2$ (98.42 g), an epoxy encapped polyether with the average structure $CH_2(O)CHCH_2O(CH_2CH_2O)_{21.7}CH_2CH(O)CH_2$ (36.56 g) and isopropanol (1500.01 g) was combined in a 500 mL flask. The material was brought to reflux and stirred with an overhead stirrer. The refluxing continued for 24 hr until all epoxy groups were consumed as determined by titration. The material was transferred to a rotary evaporator and stripped at 70° C. and 4 torr for 2 hrs to remove the isopropanol.

Example T

An epoxy end capped polyether (59.37 g) with the average structure of $CH_2(O)CHCH_2O(CH_2CH_2O)_{11.2}CH_2CH(O)CH_2$, aminopropyltriisopropoxysilane (24.38 g), aminopropyltriethylsilane (16.25 g) and isopropanol (100 g) were combined in a 500 mL round bottom flask. The solution was heat to reflux and stirred with a magnetic stirrer. The reaction was allowed to remain at reflux until all the epoxy groups were consumed as determined by titration. The resulting material exhibited a dark straw color. The material was transferred to a rotary evaporator and stripped at 70° C. and 4 torr for 2 hrs to remove the isopropanol.

Example U

An epoxy end capped polyether (34.56 g) with the average structure of $CH_2(O)CHCH_2O(CH_2CH_2O)_{11.2}CH_2CH(O)CH_2$, aminopropyltriisopropoxysilane (14.75 g), oleylamine (0.70 g) and isopropanol (50 g) were combined in a 250 mL round bottom flask. The solution was heat to reflux and stirred with a magnetic stirrer. The reaction was allowed to remain at reflux until all the epoxy groups were consumed as determined by titration. The resulting material exhibited a dark straw color. The material was transferred to a rotary evaporator and stripped at 70° C. and 4 torr for 2 hrs to remove the isopropanol.

Example V

An epoxy end capped polyether (34.92 g) with the average structure of $CH_2(O)CHCH_2O(CH_2CH_2O)_{11.2}CH_2CH(O)CH_2$, aminopropyltriisopropoxysilane (14.58 g), ethylhexylamine (0.49 g) and isopropanol (50 g) were combined in a 250 mL round bottom flask. The solution was heat to reflux and stirred with a magnetic stirrer. The reaction was allowed to remain at reflux until all the epoxy groups were consumed as determined by titration. The resulting material exhibited a dark straw color. The material was transferred to a rotary evaporator and stripped at 70° C. and 4 torr for 2 hrs to remove the isopropanol.

Coatings Application Examples

Coating of the Substrate for Examples 1-4

The products from synthesis examples A, B, C and D were made using the following method. Example A, B, C or D (5 g) was added to 20 g of distilled water. The solution was mixed with a magnetic stir bar and neutralized to pH 7 with acetic acid. The resulting formulation a listed in the table below. Example formulations numbered 1-4 were coated on cleaned and dried untreated steal plates. The coating was conducted using a 3 mil wire wound rod. 5 mL of each formulation was added to the substrate in front of the rod. The rod was pulled across the substrate at constant force and velocity. The coating was allowed to cure for 4 days at room temperature.

| | Example Formulation 1 | Example Formulation 2 | Example Formulation 3 | Example Formulation 4 |
|---|---|---|---|---|
| Example A | 20% | — | — | — |
| Example B | — | 20% | — | — |
| Example C | — | — | 20% | — |
| Example D | — | — | — | 20% |
| Water | 80% | 80% | 80% | 80% |
| Appearance | Milky | Clear | Milky | Bluish White |

Application Example 1

Gloss

Procedure from the ASTM standard test method (D 4039-87) was used. Both 20° and 60° specular gloss was taken and is shown in the table below. Two panels were coated and the gloss was measured.

| | Substrate | Cure Conditions | Gloss 20° | Gloss 60° |
|---|---|---|---|---|
| Example Formulation 1 | Untreated Steel | Room Temp 4 days | 19 | 45.4 |
| Example Formulation 1 | Untreated Steel | Room Temp 4 days | 14.1 | 35.1 |
| Example Formulation 2 | Untreated Steel | Room Temp 4 days | 10.8 | 21.7 |
| Example Formulation 2 | Untreated Steel | Room Temp 4 days | 11.4 | 22.2 |
| Example Formulation 3 | Untreated Steel | Room Temp 4 days | 23.4 | 47.1 |
| Example Formulation 3 | Untreated Steel | Room Temp 4 days | 24.6 | 50.1 |
| Example Formulation 4 | Untreated Steel | Room Temp 4 days | 14.7 | 38.3 |
| Example Formulation 4 | Untreated Steel | Room Temp 4 days | 15.3 | 38.2 |

Application Example 2

Pencil Hardness

The procedure from the standard test method for film hardness by pencil test (ASTM D3363-74) was followed. The treated steal panel was subject to multiple scratches using various hardness pencils. The results are given in the table below. The rating was based on scratch hardness or the hardest pencil that will not rupture or scratch the film.

| | Substrate | Cure Conditions | Pencil Harness |
|---|---|---|---|
| Example Formulation 1 | Untreated Steel | Room Temp 4 days | 3H |
| Example Formulation 1 | Untreated Steel | Room Temp 4 days | 3H |
| Example Formulation 2 | Untreated Steel | Room Temp 4 days | 2B |
| Example Formulation 2 | Untreated Steel | Room Temp 4 days | 2B |
| Example Formulation 3 | Untreated Steel | Room Temp 4 days | 3H |
| Example Formulation 3 | Untreated Steel | Room Temp 4 days | 3H |
| Example Formulation 4 | Untreated Steel | Room Temp 4 days | 3H |
| Example Formulation 4 | Untreated Steel | Room Temp 4 days | 3H |

Application Example 3

Cross Hatch Adhesion

Using the procedure from the standard test method for measuring adhesion by tape test (ASTM D3359-87) the crosshatch adhesion performance was evaluated. The example formulations were coated on untreated steel and allowed to cure at room temperature for 4 days. Test method B was employed where a lattice pattern was scratched into the film. The tape was applied to the scratched surface then removed. The resulting coating was evaluated for pealing and missing portion of film. No such defects were detected when all four example formulations were tested.

Application Example 4

Solvent Resistance

Using the standard test method for measuring methyl ethyl ketone (MEK) resistance (ASTM D4752-87) was employed. The coated steel substrates were first washed with Deionized water and the immediately insulted with an automated device equipped with a hammer-head and saturated with MEK cheesecloth. The samples were rubbed 15 times then examined for marring. The process was repeated using 120 oscillations and again examined for marring. The results are shown in the table below.

| | Substrate | Cure Conditions | MEK Resistance |
|---|---|---|---|
| Example Formulation 1 | Untreated Steel | Room Temp 4 days | 15 DR Some Mar |
| Example Formulation 1 | Untreated Steel | Room Temp 4 days | 120 DR Some Mar |
| Example Formulation 2 | Untreated Steel | Room Temp 4 days | 15 DR Trace Mar |
| Example Formulation 2 | | Room Temp 4 days | 120 DR Some Mar |
| Example Formulation 3 | Untreated Steel | Room Temp 4 days | 15 DR Trace Mar |
| Example Formulation 3 | Untreated Steel | Room Temp 4 days | 120 DR Some Mar |
| Example Formulation 4 | Untreated Steel | Room Temp 4 days | 15 DR Some Mar |

-continued

| | Substrate | Cure Conditions | MEK Resistance |
|---|---|---|---|
| Example Formulation 4 | Untreated Steel | Room Temp 4 days | 120 DR Some Mar |

Application Example 5

Impact Resistance

Using a standard test method for measuring the resistance of organic coatings to the effects of rapid deformation (impact, ASTM D2794-69). The total scale for this test is 1 thru 5. 5 indicates no damage; 1 is visibly cracked. A 4 rating indicates pinpoint discoloration at the center of the impact or a crack at the rim of the circle only. The coated steel panels where impacted on the coated side (direct) and on the uncoated side (reverse). The results are given below.

| | Direct Impact 80 lbs | Direct Impact 10 lbs | Reverse Impact 80 lbs | Reverse Impact 10 lbs |
|---|---|---|---|---|
| Example Formulation 1 | 4 | 4 | 4 | 5 |
| Example Formulation 2 | 4 | 4 | 4 | 5 |

-continued

| | Direct Impact 80 lbs | Direct Impact 10 lbs | Reverse Impact 80 lbs | Reverse Impact 10 lbs |
|---|---|---|---|---|
| Example Formulation 3 | 4 | 4 | 4 | 4 |
| Example Formulation 4 | 4 | 4 | 4 | 5 |

Anti-Staining Applications for Hard Surfaces Examples

The following examples demonstrate the utility of the silane ABn's for use as anti-staining coatings for the protection of hard surfaces.

Procedure for Making Coating Formulations:

Synthetic Example C, J, L, & M were diluted to a 20% aqueous formulation and neutralized with acetic acid (pH 7). The hard surfaces tested in this application were Terracotta and Marble (3"×3"). Half of each tile was treated by adding 0.5 mL of the formulation to each tile. The coating was then smoothed using an applicator in order to have a uniform coating on half of each tile. The tiles were allowed to cure overnight at ambient temperature. The control formula was a commercial hard surface sealer from HG international. The following day each tile was subjected to two drops of staining solution. The stains are listed in the table below. The stains were allowed to sit at ambient temperature on the surface for 16 hr. Then the tiles were washed with a wet sponge and Dawn dishwashing detergent. Once dry the tiles were visually rated and given a score between 0-10, 0 being no residue left behind while 10 was given if a dark stain was evident. There is a marketable improvement in stain prevention when compared to the untreated tiles.

TABLE

Stain results on various substrates

Terracotta

| | Untreated | Example Formulation 5 | Example Formulation 6 | Example Formulation 7 | Example Formulation 8 | Control Formula |
|---|---|---|---|---|---|---|
| Canola Oil | 5.8 | 1.5 | 1.5 | 5.5 | 5.5 | 0.5 |
| Colored Water | 0 | 0 | 1 | 0 | 0 | 0.5 |
| Coffee | 0.1 | 0 | 0 | 0.5 | 2 | 0 |
| Ketchup | 2.2 | 1.5 | 2 | 5 | 2 | 0.5 |
| Mustard | 10 | 1.5 | 2 | 3 | 10 | 4 |
| Red Wine | 0.6 | 0.25 | 1 | 5 | 1 | 1 |
| Mineral Oil | 5.4 | 1 | 1 | 4 | 5 | 0 |
| Cherry Cool-Aid | 0.3 | 0.5 | 1 | 0.5 | 0.5 | 0.5 |

Terracotta

| | Untreated | Example Formulation 9N | Example Formulation 10 | Control Formula |
|---|---|---|---|---|
| Canola Oil | 7.5 | 2 | 5 | 0.5 |
| Colored Water | 0.8 | 0 | 0 | 5 |
| Coffee | 1.5 | 6 | 8 | 0.5 |
| Ketchup | 5.5 | 2 | 1 | 1 |
| Mustard | 9.3 | 2 | 3 | 9.5 |
| Red Wine | 1.3 | 3 | 6 | 1 |
| Mineral Oil | 6.5 | 1.5 | 1.5 | 0.5 |
| Cherry Cool-Aid | 0.5 | 1 | 0 | 0 |

| | Untreated | Example Formulation 9 | Example Formulation 10 | Control Formula |
|---|---|---|---|---|
| Granite | | | | |
| Canola Oil | 0 | 0 | 0 | 0 |
| Colored Water | 0 | 0 | 0 | 0 |
| Coffee | 0 | 2 | 5 | 0 |
| Ketchup | 0 | 0 | 0 | 2 |
| Mustard | 8.8 | 0 | 0 | 0 |
| Red Wine | 5.5 | 7 | 8 | 0 |
| Mineral Oil | 0 | 0 | 0 | 0 |

TABLE-continued

| Stain results on various substrates | | | | |
|---|---|---|---|---|
| Cherry Cool-Aid | 0 | 2 | 4 | 0 |
| | | Marble | | |
| Canola Oil | 0 | 0 | 0 | 0 |
| Colored Water | 2 | 0 | 0 | 0 |
| Coffee | 5 | 1 | 0 | 0 |
| Ketchup | 0 | 0 | 0 | 0 |
| Mustard | 0.5 | 0 | 0 | 0 |
| Red Wine | 7 | 2 | 0 | 0 |
| Mineral Oil | 0 | 0 | 0 | 0 |
| Cherry Cool-Aid | 0 | 2 | 0.5 | 0.5 |

Non-Woven Application Examples

Treatment of Spun Polypropylene

The formulations were made accordingly to the table below. All formulations were neutralized with acetic acid to pH 7. Each example formula was applied to a 100% polypropylene (PP) nonwoven coverstock (Spunbonded Polypropylene 22 g/m2) at 0.5% add-on at 100% pick-up. The nonwoven finish was applied to PP diaper coverstock by the padding method and drying conditions in a Werner Mathis AG dryer for 90 sec@105° C. After treatment the PP diaper coverstock was placed at ambient temperature for 24 hrs before any physical evaluations take place. These treated PP diaper coverstock materials were used for all the non-woven application examples.

| | Example Formulation 11 | Example Formulation 12 | Example Formulation 13 | Example Formulation 14 |
|---|---|---|---|---|
| Example C | 0.5% | — | — | — |
| Example D | — | 0.5% | — | — |
| Example L | — | — | 0.5% | |
| Example M | — | — | — | 0.5% |
| Water | 99.5% | 99.5% | 99.5% | 99.5% |

Run-Off Application

Run-Off experiments were performed following the standard Edana 152.0-99. Given in the table is the percent run-off of a 0.9% sodium chloride solution when applied to a piece of treated spun polypropylene held at a 25° angle. Two different sets of treatments were chosen. Example formulations 11 and 12 are hydrophobic treatment while examples 13 and 14 are hydrophilic. An untreated sheet of polypropylene was used for comparison.

TABLE

| Percent run off of 4 treated spun polypropylene sheets | | | | | | |
|---|---|---|---|---|---|---|
| | Run 1 | Run 2 | Run 3 | Run 4 | Run 5 | Run 6 |
| Example Formulation 11 | 80.40% | 94.40% | 96.40% | 84.80% | 80.80% | 84.04% |
| Example Formulation 12 | 91.68% | 88.76% | 88.72% | 85.20% | 87.24% | 90.16% |
| Example Formulation 13 | 82.92% | 39.72% | 15.60% | 0.00% | 0.00% | 4.36% |
| Example Formulation 14 | 69.84% | 21.84% | 58.80% | 21.50% | 51.12% | 8.92% |
| Untreated | 93.80% | 96.04% | 95.24% | 92.00% | 97.84% | 97.24% |

Strike Through

Run-Off experiments were performed following the standard Edana Strike Through Time 150.3-96. Given in the table is the percent run-off of a 0. 9% sodium chloride solution when applied to a piece of treated spun polypropylene held at a 25° angle. Two different sets of treatments were chosen. Example formulations 11 and 12 are hydrophobic treatment while examples 13 and 14 are hydrophilic. An untreated sheet of polypropylene was used for comparison.

| | Time |
|---|---|
| Example Formulation 11 | 30.56 sec |
| Example Formulation 12 | 115.01 sec |
| Example Formulation 13 | 8.87 sec |
| Example Formulation 14 | 13.05 sec |
| Untreated | 245.95 sec |

Hydrostatic Pressure Test Inda Standard Test IST 80.4

A Hydrodrostatic pressure test was performed on the treated polypropylene to test resistance to water penetration when a column of water was placed on the surface. The treated polypropylene was sandwiched between two pieces of plastic with a 2" circular hole in both. The upper piece was attached to a graduated column. Water was introduced through in inlet just over the PP material at a rate that did not allow for a vortex to form. A mirror was positioned below the apparatus and the water was added to the column. The height of the water was recorded once drops of water formed and released from the bottom of the apparatus. The data is shown in the table below. For formulations 13 and 14 no buildup occurred and the water immediately penetrated and began to flow through the polypropylene.

| | Water Height |
|---|---|
| Example Formulation 11 | 1.3 cm |
| Example Formulation 12 | 1.3 cm |
| Example Formulation 13 | Instant |
| Example Formulation 14 | Instant |
| Untreated | 1.0 cm |

Migration

The effect of migration of was examined for the treated polypropylene diaper coverstock. Migration of the hydrophilic coating to adjoining untreated polypropylene is highly undesirable. Dry migration will result in leaks in the final product. The following procedure was used to examine the resistance to migration of the coated polypropylene. Untreated 100% spunbonded SMS (Spunbonded/Meltblown/Spunbonded) polypropylene webs were placed beneath and above 100% spunbonded polypropylene nonwoven web treated with either example formulations 13 or 14. A weight (0.5 lb./in$^2$) was placed on the nonwoven textiles for 1 week at 50° C. to simulate storage and all layers evaluated for hydrophilicity (MTCC Test Method 79-1995). The desired result is to have the top and bottom layers remain hydrophobic and the treated nonwoven to remain hydrophilic. Any change in hydrophilicity of either the top or bottom layer of polypropylene is considered migration. The test was terminated at 300 sec per measurement.

| Middle Layer Treatment | Sheet Location | Strike Through Time |
|---|---|---|
| Example Formulation 13 | Top | >300 sec |
| Example Formulation 13 | Middle | 32 |
| Example Formulation 13 | Bottom | >300 sec |
| Example Formulation 14 | Top | >300 sec |
| Example Formulation 14 | Middle | 11 |
| Example Formulation 14 | Bottom | >300 sec |
| Untreated | Untreated | >300 sec |

No migration was found when either hydrophilic treatment was used. For comparison the process was repeated with a non-curing commercial diaper coverstock treatment. The top and bottom layers exhibited a strike through time of 90-100 seconds. Clearly the hydrophilic treatment migrated from the treated PP to the non-treated PP.

Textile Applications Formulations

| | Example Form. 15 | Example Form. 16 | Example Form. 17 | Example Form. 18 | Example Form. 19 | Example Form. 20 |
|---|---|---|---|---|---|---|
| Example O | 0.5% | — | — | — | — | — |
| Example P | — | 0.5% | — | — | — | — |
| Example R | — | — | 0.5% | | — | — |
| Example L | — | — | — | 0.5% | — | — |
| Example D | — | — | — | — | 0.5% | — |
| Example S | — | — | — | — | — | 0.5% |
| Water | 99.5% | 99.5% | 99.5% | 99.5% | 99.5% | 99.5% |

The synthetic example O, P, R or L was combined with deionized water in a beaker, stirred with an overhead stirrer then acidified to pH 5 with acetic acid.

Formulation and Preparation Procedure for Making a Microemulsion of Control Formulation 2

A 20% microemulsion of Magnasoft Derma NT was made by the addition of 25.0 grams of a commercial polysilicone quat (Momentive Performance Materials) into a disposable beaker to 10.5 grams of TDA-6 and 1.8 grams of TDA-12 (both surfactants made by Ethox). The mixture was stirred using a mechanical stirrer, at moderate speed (~600 rpm) for 5 minutes. Separately a solution of 62.0 grams of deionized water, 0.4 grams of acetic acid, and 0.3 grams of sodium acetate was combined in an addition funnel. The water, acetic acid, and sodium acetate solution was added drop wise over 30 minutes. After the final addition the emulsion was stirred for an additional 10 minutes.

For treatment in the Pad Bath a dilution of the 20% microemulsion was required. A mechanical stirrer was used and deionized water was added with moderate stirring (~600 rpm) until all the material has been evenly dispersed at an actives concentration of 0.5%.

Treatment by Pad Bath

The diluted treatments (0.5% actives, 150 g) were poured into a disposable beaker. A piece of untreated fabric was weighed and the mass was recorded. The fabric was immersed in the treating solution for 30 seconds or until completely wet. The saturated fabric was passed through a Werner Mathis padder fitted with 4.5" rubber rollers (roller speed—6 M/min, roller pressure—0.5 bar). The fabric was reweighed and the roller pressure was adjusted until 100% wet pick up was achieved. Immediately following the treatment the swatch was placed in a fabric oven at 130° C. for 5 minutes to dry the sample.

Fabric Conditioning

Prior to any physical evaluation of the treated and untreated fabrics, the swatches were placed in an environmental chamber set at 21° C. and 65% RH for a minimum of 24 hours.

Wet Out

The ability of the treatment to increase (hydrophobicity) or decrease (hydrophilicity) the time required for a drop of water to penetrate the surface of the fabric. This test was performed in accordance with the AATCC Test Method 79-1992. A piece of treated or untreated cotton knit fabric was secured in a 6" embroidery ring. Care was taken as to not stretch the fabric but the fabric was taut and free of folds or wrinkles. A drop of deionized water was applied onto the fabric via a dropper and a timer was started. The timer was stopped when the drop of water completely penetrated the fabric and was record in seconds. The process was repeated 6 times at different positions for each fabric. The value reported is the average of these readings, shown in the table below. The test was terminated at 600 seconds. A value of 600 seconds indicates that the drop never penetrated the surface of the fabric.

| Trial | Example Form. 15 | Example Form. 16 | Example Form. 17 | Example Form. 18 | Control Form. 2 | Untreated |
|---|---|---|---|---|---|---|
| 1 | 600 | 80 | 4 | 10 | 10 | 34 |
| 2 | 600 | 21 | 4 | 12 | 10 | 35 |
| 3 | 600 | 74 | 5 | 14 | 12 | 32 |
| 4 | 600 | 32 | 5 | 11 | 12 | 44 |
| 5 | 600 | 145 | 3 | 18 | 12 | 45 |
| 6 | 600 | 92 | 4 | 20 | 13 | 49 |
| Aver. | 600 | 74 | 4.2 | 14.2 | 11.5 | 39.8 |

The test was repeated for the hydrophobic treatment example formulation 15. Shown in the table are the results when cotton knit fabric is treated and washed. After 1, 3, 5, 10, and 20 washes the fabric was tested for wet out. The fabric remained highly hydrophobic even after 20 washes. The wash/dry procedure is described in the durability section below.

| | Number of Wash Cycles | | | | |
|---|---|---|---|---|---|
| Trial | 1 | 3 | 5 | 10 | 20 |
| 1 | 600 | 600 | 600 | 410 | 125 |
| 2 | 600 | 600 | 600 | 420 | 118 |
| 3 | 600 | 600 | 600 | 335 | 92 |
| 4 | 600 | 600 | 600 | 480 | 130 |
| 5 | 600 | 600 | 600 | 551 | 95 |
| 6 | 600 | 600 | 600 | 458 | 116 |
| Average | 600 | 600 | 600 | 442.3 | 112.7 |

Wicking

A wicking test was performed in order to evaluate how well the treatments enhance or deter the wicking of water through the fabric. This test was performed in accordance with the ASTM D-5237 test protocol. A 2"×7" strip of treated or untreated fabric was cut from different sample sheets. One end the fabric was marked with a pencil line ~15 mm from the edge. 2 standard metal paper clips were fastened between this line and the edge of the sample. The other end of the fabric was secured to a stand with a large (#100) binder clip. The fabric was immersed up to the pencil line in a beaker of colored water. After 6 minutes the fabric samples were removed from the water and the distance from the pencil line to the final position of the wicked water was measured with a ruler and recorded in millimeters. The procedure was repeated 4 times and the measurement were averaged and given in the table below.

| Trial | Example Form. 15 | Example Form. 16 | Example Form. 19 | Untreated | Control Form. 2 |
|---|---|---|---|---|---|
| 1 | 15.39 | 76.07 | 0 | 42 | 73.2 |
| 2 | 15.95 | 74.5 | 0 | 40.7 | 73.3 |
| 3 | 12.86 | 72.37 | 0 | 36.4 | 71.9 |
| 4 | 13.15 | 74.1 | 0 | 43 | 72.8 |
| 5 | 12.54 | 72.85 | 0 | 38.9 | 70.3 |
| 6 | 13.53 | 71.67 | 0 | 39.8 | 71.2 |
| Average | 13.9 | 73.6 | 0 | 40.2 | 72.1 |

Durability (Machine Wash/Dry)

The durability study examined how long the treatment remained on cotton knit fabric after repetitive washing and drying. A treated 11"×11" swatch of fabric was placed in a top loader washing machine. The machine was set to a regular wash cycle for a wash period of 12 minutes with a 19 gallon water fill and a temp of 87° F. The detergent used was 60 grams of AATCC Standard Reference Detergent. Once washed the fabric swatches were dried by placing them in a front loader dryer set on timed dry, high heat for 30 minutes. The process was repeated for the given number of wash/dry cycles as dictated in the table below. The fabric samples were then exposed to a $BF_3$ digestion and the silicone content was measured using a GC. The values reported are the percent silicone the remains after the number of washes. For the hydrophilic treatments.

| Cycles | Control Formulation 2 | Example Formulation 19 |
|---|---|---|
| 0 | 100% | 100% |
| 1 | 49% | 89% |
| 3 | 35% | No Data |
| 5 | 31% | 117% |
| 10 | 23% | 78% |
| 20 | No Data | 72% |

The test was repeated with example formulation 19 on a 50/50 polyester cotton blend, Dacron, and Nylon. The treatment was not removed after 20 washes for the polyester/cotton blend. There was a decrease in the silicone content for the treated Dacron and Nylon.

| | 0 | 1 | 5 | 10 | 20 |
|---|---|---|---|---|---|
| Polyester/Cotton Blend 50/50 | 100% | 77% | 118% | 123% | 114% |
| Dacron | 100% | 20% | 9% | 4% | 1% |
| Nylon | 100% | 19% | 36% | 15% | 22% |

Spray Test

An alternate test for durability was performed. A Spray Test was run according to AATCC test method 22-1989. Treated cotton knit fabric was washed in the same manner as described in the Durability section above for 1, 3, 5, 10 and 20 wash/dry cycles. The fabric was secured a 6" embroidery ring. Care was taken so that the fabric did not stretch but it was taut and free of folds or wrinkles. The assembly was placed on the spray test apparatus that consisted of stand holding a jig set at a 45° angle positioned below a large funnel and showerhead. 250 mL of deionized water was poured through the funnel and showerhead onto the test specimen. The specimen/ring was removed and visually rated 0-100 by comparing its appearance to the spray test rating standard. The control sample was an untreated piece of cotton knit. The results are shown in the table below. The high numbers of 121-113 indicate that the surface remains hydrophobic even after 20 washes.

| Wash Cycles | Control Formulation 2 | Example Formulation 19 | Untreated |
|---|---|---|---|
| 0 | 75 | 100 | 0 |
| 1 | 50 | 100 | 0 |
| 3 | 10 | 95 | 0 |
| 5 | 0 | 90 | 0 |
| 10 | 0 | 80 | 0 |
| 20 | 0 | 80 | 0 |

Hand (Soft/Bulk/Slick)

A panel of 5 people was designated to determine the softness and bulkiness that the treatment imparts to cotton knit fabric. The test panels were asked to rate the softness of the fabric from 1 to 10. An untreated swatch of fabric was used to indicate a 1. A high value indicates a very soft and pleasant feel. Most of the formulations tested performed well against the untreated control.

| Treatment | Rating |
|---|---|
| Untreated | 1 |
| Control Formulation 2 | 7.7 |
| Example Formulation 18 | 1 |
| Example Formulation 20 | 7.3 |
| Example Formulation 15 | 6.4 |
| Example Formulation 19 | 6.9 |

The foregoing examples are merely illustrative of the invention, serving to illustrate only some of the features of the present invention. The appended claims are intended to claim the invention as broadly as it has been conceived and the examples herein presented are illustrative of selected embodiments from a manifold of all possible embodiments. Accordingly it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of." Where necessary, ranges have been supplied; those ranges are inclusive of all sub-ranges there between. Such ranges may be viewed as a Markush group or a collection of Markush groups consisting of differing pair wise numerical limitations which group or groups is or are fully delimited by its lower and upper bounds, increasing in a regular fashion numerically from lower bounds to upper bounds. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims. All United States patents (and patent applications) referenced herein are herewith and hereby specifically incorporated by reference in their entirety as though set forth in full.

While in the foregoing, embodiments of this invention have been disclosed in considerable detail for purposes of illustration, those skilled in the art will realize that such details may be varied without departing from the spirit and scope of the invention.

What is claimed is:

1. A treated textile treated with a composition consisting essentially of the reaction product of a) an oxirane or oxetane compound comprising only two oxirane or oxetane endcapping groups; and b) an amino silane having the formula:

$$N(H)(R^1)R^2Si(OR^3)_{3-a-b-c}(OR^4)_a(R^5Si(OR^6)_d(R^7)_e)_bR^8_c$$

with $R^1$ is H;

$R^2$ is selected from a group consisting of a divalent linear or branched hydrocarbon radical consisting of 1-60 carbons;

$R^4$ is a hydrocarbon radical that contains 3 to 200 carbon atoms;

$R^5$ is selected from a group consisting of oxygen or a divalent linear or branched hydrocarbon radical consisting of 1-60 carbons;

$R^3$, $R^6$, $R^7$, and $R^8$ and are each independently selected from the group of monovalent linear or branched hydrocarbon radicals having from 1 to 200 carbon atoms;

the subscript b is zero or a positive number and has a value ranging from 0 to 3;

the subscripts a, and c are zero or positive and have a value ranging from 0 to 3 subject to the limitation that $(a+b+c)\leq 3$;

the subscripts d and e are zero or positive and have a value ranging from 0 to 3 subject to the limitation that $(d+e)=3$, wherein said reaction product is a linear [AB] type diblock copolymer of said oxirane or oxetane and said amino silane, and wherein said treated textile has enhanced wet strength, wherein A represents the oxetane or oxirane block and B represents the aminosilane block.

2. The treated textile of claim 1 where the oxirane or oxetane compound is selected from the group consisting of siloxanes, hydrocarbons and polyethers.

3. The treated textile of claim 2 where the oxirane or oxetane compound is a siloxane having the formula:

$$M_jM^E_hM^{PE}_iM^H_jD_kD^E_lD^{PE}_mD^H_nT_oT^E_pT^{PE}_qT^H_rQ_s$$

with $$M=R^9R^{10}R^{11}SiO_{1/2};$$

$$M^H=R^{12}R^{13}H\ SiO_{1/2};$$

$$M^{PE}=R^{12}R^{13}(—CH_2CH(R^{14})(R^{15})_tO(R^{16})_u(C_2H_4O)_v(C_3H_6O)_w(C_4H_8O)_xR^{17})SiO_{1/2};$$

$$M^E=R^{12}R^{13}(R^E)SiO_{1/2}$$

$$D=R^{18}R^{19}SiO_{2/2};\text{ and}$$

$$D^H=R^{20}HSiO_{2/2}$$

$$D^{PE}=R^{20}(—CH_2CH(R^{14})(R^{15})_tO(R^{16})_u(C_2H_4O)_v(C_3H_6O)_w(C_4H_8O)_xR^{17})SiO_{2/2}$$

$$D^E=R^{20}R^ESiO_{2/2}$$

$$T=R^{21}SiO_{3/2};$$

$$T^H=HSiO_{3/2};$$

$$T^{PE}=(—CH_2CH(R^{14})(R^{15})_tO(R^{16})_u(C_2H_4O)_v(C_3H_6O)_w(C_4H_8O)_xR^{17})SiO_{3/2};$$

$$T^E=R^ESiO_{3/2};\text{ and}$$

$$Q=SiO_{4/2};$$

where $R^9$, $R^{10}$, $R^{11}$, $R^{12}$, $R^{13}$, $R^{18}$, $R^{19}$, $R^{20}$, and $R^{21}$ are each independently selected from the group of monovalent hydrocarbon radicals having from 1 to 60 carbon atoms;

$R^{14}$ is H or a 1 to 6 carbon atom alkyl group; $R^{15}$ is a divalent alkyl radical of 1 to 6 carbons; $R^{16}$ is selected from the group of divalent radicals consisting of $—C_2H_4O—$, $—C_3H_6O—$, and $—C_4H_8O—$; $R^{17}$ is selected from the group consisting of H, monofunctional hydrocarbon radicals of 1 to 6 carbons, and acetyl;

$R^E$ is independently a monovalent hydrocarbon radical containing one or more oxirane or oxetane moieties having from two to sixty carbon atoms;

the subscript f may be zero or positive subject to the limitation that when the subscript f is zero, h must be positive;

the subscript h is zero or positive subject to the limitations that when h is zero, the subscript f is positive, and that the sum of the subscripts h, l and p is positive;

the subscript k is zero or positive and has a value ranging from about 0 to about 1,000;

the subscript l is zero or positive and has a value ranging from about 0 to about 400 subject to the limitation that the sum of the subscripts h, l and p is positive;

the subscript o is zero or positive and has a value ranging from 0 to about 50;

the subscript p is zero or positive and has a value ranging from 0 to about 30 subject to the limitation that the sum of the subscripts h, l and p is positive;

the subscript s is zero or positive and has a value ranging from 0 to about 20;

the subscript i is zero or positive and has a value ranging from 0 to about 20;

the subscript m is zero or positive and has a value ranging from 0 to about 200;

the subscript q is zero or positive and has a value ranging from 0 to about 30;

the subscript j is zero or positive and has a value ranging from 0 to about 2;

the subscript n is zero or positive and has a value ranging from 0 to about 20;

the subscript r is zero or positive and has a value ranging from 0 to about 30;

the subscript t is zero or one;

the subscript u is zero or one;

the subscript v is zero or positive and has a value ranging from 0 to about 100 subject to the limitation that (v+w+x)>0;

the subscript w is zero or positive and has a value ranging from 0 to about 100 subject to the limitation that (v+w+x)>0; and the subscript x is zero or positive and has a value ranging from 0 to about 100 subject to the limitation that (v+w+x)>0.

4. The treated textile of claim 1 where the oxirane or oxetane compound is a hydrocarbon having the formula:

$$R^{22}{}_{y}(R^{23})_{z}(R^{24}{}_{\alpha})(R^{25})_{\beta}$$

where $R^{22}$ and $R^{25}$ are independently a monovalent hydrocarbon radical containing one or more oxirane or oxetane moieties having from 3 to 12 carbon atoms;

$R^{23}$ and $R^{24}$ are each selected from the group consisting of a linear and a branched divalent hydrocarbon radical of 1 to 1000 carbons;

the subscripts y, z, α, β are zero or positive ranging from zero to four subject to the limitation that (y+β)=2.

5. The treated textile of claim 2 where the oxirane or oxetane compound is a polyether having the formula:

$$R^{26}O(R^{27})_{\gamma}(C_2H_4O)_{\delta}(C_3H_6O)_{\epsilon}(C_4H_8O)_{\zeta}R^{28}$$

where $R^{26}$ and $R^{28}$ are independently a monovalent hydrocarbon radical containing one or more oxirane or oxetane moieties having from 3 to 12 carbon atoms;

$R^{27}$ is selected from the group of divalent radicals consisting of —$C_2H_4O$—, —$C_3H_6O$—, and —$C_4H_8O$—;

the subscript γ is zero or 1;

the subscript δ is zero or positive and has a value ranging from 0 to about 100 subject to the limitation that (δ+ϵ+ζ)>0;

the subscript ϵ is zero or positive and has a value ranging from 0 to about 100 subject to the limitation that (δ+ϵ+ζ)>0;

the subscript ζ is zero or positive and has a value ranging from 0 to about 100 subject to the limitation that (δ+ϵ+ζ)>0.

6. The treated textile of claim 3 wherein the composition producing said reaction product further comprises a compound having the formula:

$$R^{29}(R^{30})_{\kappa}Si(OR^{31})_{3-\eta-\theta}(R^{32})_{\eta}(OR^{33})_{\theta}$$

where $R^{29}$ is a monovalent hydrocarbon radical containing one or more oxirane or oxetane moieties having from 3 to 12 carbon atoms;

$R^{30}$ is a divalent hydrocarbon radical consisting of 1-60 carbons and the subscript κ has a value of zero or 1; $R^{31}$ and $R^{32}$ are independently selected from the group of monovalent linear or branched hydrocarbon radicals having from 1 to 60 carbon atoms;

the subscript η is zero or positive and has a value ranging from 0 to 3;

the subscript θ is greater than 0 and less than or equal to 3, subject to the limitation that 3−η−θ is greater than or equal to zero; and $R^{33}$ is a hydrocarbon radical that contains 3 to 200 carbon atoms.

7. The treated textile of claim 6 wherein $R^2$ has from one to ten carbon atoms;

$R^4$ has from three to ten carbon atoms;

$R^3$, $R^6$, $R^7$, and $R^8$ each independently have from one to twenty carbon atoms;

the subscript a ranges from 1 to 3;

the subscript b ranges from 0 to 25;

the subscript c ranges from 0 to 3;

$R^9$, $R^{10}$, $R^{11}$, $R^{12}$, $R^{13}$, $R^{18}$, $R^{19}$, $R^{20}$, and $R^{21}$ each independently have from one to four carbon atoms;

the subscripts f, l, m, n, o, p, q, r, each independently range from 0 to 200;

the subscript k ranges from 0-500;

the subscripts v, w, and x each independently range from 0 to 50;

$R^{31}$ and $R^{32}$ each independently have from one to ten carbon atoms and $R^{33}$ has from three to one hundred carbon atoms.

8. The treated textile of claim 6 wherein $R^2$ has from two to eight carbon atoms;

$R^4$ has from three to eight carbon atoms;

$R^3$, $R^6$, $R^7$, and $R^8$ each independently have from one to fifteen carbon atoms;

the subscript a ranges from 2 to 3;

the subscript b ranges from 0 to 15;

the subscript c ranges from 0 to 2;

$R^9$, $R^{10}$, $R^{11}$, $R^{12}$, $R^{13}$, $R^{18}$, $R^{19}$, $R^{20}$, and $R^{21}$ each independently have from one to three carbon atoms;

the subscripts f, l, m, n, o, p, q, r, each independently range from 0 to 100;

the subscript k ranges from 5-250;

the subscripts v, w, and x each independently range from 0 to 35;

$R^{31}$ and $^{32}$ each independently have from one to eight carbon atoms and $R^{33}$ has from three to fifty carbon atoms.

9. The treated textile of claim 6 wherein $R^2$ has from two to five carbon atoms;

$R^4$ has from three to five carbon atoms;

$R^3$, $R^6$, $R^7$, and $R^8$ each independently have from two to eight carbon atoms;

the subscript a is 3;

the subscript b is 0;

the subscript c is 0;

$R^9$, $R^{10}$, $R^{11}$, $R^{12}$, $R^{13}$, $R^{18}$, $R^{19}$, $R^{20}$, and $R^{21}$ each independently methyl;

the subscripts f, l, m, n, o, p, q, r, each independently range from 0 to 50;

the subscript k ranges from 5 to 150;

the subscripts v, w, and x each independently range from 0 to 25;

$R^{31}$ and $^{32}$ each independently have from one to four carbon atoms and $R^{33}$ has from three to ten carbon atoms.

10. The treated textile of claim 7 wherein $R^2$ has from one to five carbon atoms;

$R^4$ has from three to five carbon atoms;

$R^3$, $R^6$, $R^7$, and $R^8$ each independently have from two to eight carbon atoms;

the subscript a ranges from 1 to 2;

the subscript b ranges from 0 to 15;

the subscript c ranges from 1 to 3;

$R^9$, $R^{10}$, $R^{11}$, $R^{12}$, $R^{13}$, $R^{18}$, $R^{19}$, $R^{20}$, and $R^{21}$ each independently have from one to three carbon atoms;

the subscripts f, l, m, n, o, p, q, r, each independently range from 0 to 50;

the subscript k ranges from 5 to 150;

the subscripts v, w, and x each independently range from 1 to 10;

$R^{31}$ and $^{32}$ each independently have from one to four carbon atoms and $R^{33}$ has from three to fifty carbon atoms.

11. A treated textile treated with an aqueous emulsion where the discontinuous phase comprises water and the emulsion comprises the copolymer of claim 1.

12. A treated textile treated with an aqueous emulsion where the discontinuous phase comprises water and the emulsion comprises the copolymer of claim 2.

13. A treated textile treated with an aqueous emulsion where the discontinuous phase comprises water and the emulsion comprises the copolymer of claim 3.

14. A treated textile treated with an aqueous emulsion where the discontinuous phase comprises water and the emulsion comprises the composition of claim 4.

15. A treated textile treated with an aqueous emulsion where the discontinuous phase comprises water and the emulsion comprises the composition of claim 5.

16. A treated textile treated with an aqueous emulsion where the discontinuous phase comprises water and the emulsion comprises the copolymer of claim 6.

17. A treated textile treated with an aqueous emulsion where the discontinuous phase comprises water and the emulsion comprises the copolymer of claim 7.

18. A treated textile treated with an aqueous emulsion where the discontinuous phase comprises water and the emulsion comprises the copolymer of claim 8.

19. A treated textile treated with an aqueous emulsion where the discontinuous phase comprises water and the emulsion comprises the copolymer of claim 9.

20. A treated textile treated with an aqueous emulsion where the discontinuous phase comprises water and the emulsion comprises the copolymer of claim 10.

21. A treated textile treated with an aqueous emulsion where the continuous phase comprises water and the emulsion comprises the copolymer of claim 1.

22. A treated textile treated with an aqueous emulsion where the continuous phase comprises water and the emulsion comprises the copolymer of claim 2.

23. A treated textile treated with an aqueous emulsion where the continuous phase comprises water and the emulsion comprises the copolymer of claim 3.

24. A treated textile treated with an aqueous emulsion where the continuous phase comprises water and the emulsion comprises the composition of claim 4.

25. A treated textile treated with an aqueous emulsion where the continuous phase comprises water and the emulsion comprises the composition of claim 5.

26. A treated textile treated with an aqueous emulsion where the continuous phase comprises water and the emulsion comprises the composition of claim 6.

27. A treated textile treated with an aqueous emulsion where the continuous phase comprises water and the emulsion comprises the composition of claim 7.

28. A treated textile treated with an aqueous emulsion where the continuous phase comprises water and the emulsion comprises the composition of claim 8.

29. A treated textile treated with an aqueous emulsion where the continuous phase comprises water and the emulsion comprises the composition of claim 9.

30. A treated textile treated with an aqueous emulsion where the continuous phase comprises water and the emulsion comprises the composition of claim 10.

31. A treated textile treated with a non-aqueous emulsion where the discontinuous phase comprises a non-aqueous hydroxylic solvent and the emulsion comprises the composition of claim 1.

32. A treated textile treated with a non-aqueous emulsion where the discontinuous phase comprises a non-aqueous hydroxylic organic solvent and the emulsion comprises the composition of claim 2.

33. A treated textile treated with a non-aqueous emulsion where the discontinuous phase comprises a non-aqueous hydroxylic organic solvent and the emulsion comprises the composition of claim 3.

34. A treated textile treated with a non-aqueous emulsion where the discontinuous phase comprises a non-aqueous hydroxylic organic solvent and the emulsion comprises the composition of claim 4.

35. A treated textile treated with a non-aqueous emulsion where the discontinuous phase comprises a non-aqueous hydroxylic organic solvent and the emulsion comprises the composition of claim 5.

36. A treated textile treated with a non-aqueous emulsion where the discontinuous phase comprises a non-aqueous hydroxylic organic solvent and the emulsion comprises the composition of claim 6.

37. A treated textile treated with a non-aqueous emulsion where the discontinuous phase comprises a non-aqueous hydroxylic organic solvent and the emulsion comprises the composition of claim 7.

38. A treated textile treated with a non-aqueous emulsion where the discontinuous phase comprises a non-aqueous hydroxylic organic solvent and the emulsion comprises the composition of claim 8.

39. A treated textile treated with a non-aqueous emulsion where the discontinuous phase comprises a non-aqueous hydroxylic organic solvent and the emulsion comprises the composition of claim 9.

40. A treated textile treated with a non-aqueous emulsion where the discontinuous phase comprises a non-aqueous hydroxylic organic solvent and the emulsion comprises the composition of claim 10.

41. A treated textile treated with a non-aqueous emulsion where the continuous phase comprises a non-aqueous hydroxylic organic solvent and the emulsion comprises the composition of claim 1.

42. A treated textile treated with a non-aqueous emulsion where the continuous phase comprises a non-aqueous hydroxylic organic solvent and the emulsion comprises the composition of claim 2.

43. A treated textile treated with a non-aqueous emulsion where the continuous phase comprises a non-aqueous hydroxylic organic solvent and the emulsion comprises the composition of claim 3.

44. A treated textile treated with a non-aqueous emulsion where the continuous phase comprises a non-aqueous hydroxylic organic solvent and the emulsion comprises the composition of claim 4.

45. A treated textile treated with a non-aqueous emulsion where the continuous phase comprises a non-aqueous hydroxylic organic solvent and the emulsion comprises the composition of claim 5.

46. A treated textile treated with a non-aqueous emulsion where the continuous phase comprises a non-aqueous hydroxylic organic solvent and the emulsion comprises the composition of claim 6.

47. A treated textile treated with a non-aqueous emulsion where the continuous phase comprises a non-aqueous hydroxylic organic solvent and the emulsion comprises the composition of claim 7.

48. A treated textile treated with a non-aqueous emulsion where the continuous phase comprises a non-aqueous hydroxylic organic solvent and the emulsion comprises the composition of claim 8.

49. A treated textile treated with a non-aqueous emulsion where the continuous phase comprises a non-aqueous hydroxylic organic solvent and the emulsion comprises the composition of claim 9.

50. A treated textile treated with a non-aqueous emulsion where the continuous phase comprises a non-aqueous hydroxylic organic solvent and the emulsion comprises the composition of claim 10.

* * * * *